US008845052B2

(12) United States Patent
Tamura et al.

(10) Patent No.: US 8,845,052 B2
(45) Date of Patent: Sep. 30, 2014

(54) LIQUID EJECTING APPARATUS AND CONTROL METHOD THEREOF

(71) Applicant: Seiko Epson Corporation, Tokyo (JP)

(72) Inventors: Noboru Tamura, Nagano-ken (JP); Shinichi Yamada, Nagano-ken (JP); Akito Sato, Nagano-ken (JP); Toru Matsuyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 13/849,675

(22) Filed: Mar. 25, 2013

(65) Prior Publication Data

US 2014/0035979 A1 Feb. 6, 2014

(30) Foreign Application Priority Data

Jul. 31, 2012 (JP) ..... 2012-169311

(51) Int. Cl.
*B41J 29/38* (2006.01)
*B41J 2/07* (2006.01)

(52) U.S. Cl.
CPC ..... *B41J 2/07* (2013.01)
USPC ..... 347/11; 347/9

(58) Field of Classification Search
USPC ..... 347/5, 9, 10, 11, 57, 68, 70–71
See application file for complete search history.

(56) References Cited

U.S. PATENT DOCUMENTS 5,980,013 A * 11/1999 Takahashi ..... 347/14
6,281,913 B1 * 8/2001 Webb ..... 347/11
7,448,708 B2 * 11/2008 Nakayama ..... 347/10

FOREIGN PATENT DOCUMENTS

JP 2003-266700 A 9/2003
JP 2008-044233 A 2/2008
JP 2009-056669 A 3/2009

* cited by examiner

*Primary Examiner* — Juanita D Jackson

(57) ABSTRACT

A liquid ejecting apparatus includes a drive signal generation section which generates a drive signal and a liquid ejecting head. The drive signal is a periodic signal. One period of the drive signal has two durations of (i) a droplet ejection duration with a waveform part used to eject the droplet from the nozzle and (ii) a droplet non-ejection duration without the waveform part used to eject the droplet from the nozzle, and the droplet non-ejection duration is equal to or longer than the droplet ejection duration.

20 Claims, 15 Drawing Sheets

RELATIONSHIP BETWEEN DOT SIZE AND SELECTION PULSE

| PIXEL GRADATION VALUE OF PRINT DATA | VALUE OF PULSE SELECTION SIGNAL PSS | DOT SIZE | SELECTION PULSE |
|---|---|---|---|
| 00 | 0010 | NON-DOT | VP1 |
| 01 | 0100 | SMALL DOT | DP2 |
| 10 | 0001 | MIDDLE DOT | DP3 |
| 11 | 1000 | LARGE DOT | DP1 |

FIRST EMBODIMENT

REFERENCE EXAMPLE

FIG. 5

RELATIONSHIP BETWEEN DOT SIZE AND SELECTION PULSE

| PIXEL GRADATION VALUE OF PRINT DATA | VALUE OF PULSE SELECTION SIGNAL PSS | DOT SIZE | SELECTION PULSE |
|---|---|---|---|
| 00 | 0010 | NON-DOT | VP1 |
| 01 | 0100 | SMALL DOT | DP2 |
| 10 | 0001 | MIDDLE DOT | DP3 |
| 11 | 1000 | LARGE DOT | DP1 |

FIRST EMBODIMENT

SECOND EMBODIMENT

THIRD EMBODIMENT (DUMMY PULSE)

TYPE OF DRIVE SIGNAL PULSE

- DP1 TO DP3: INK EJECTING PULSE
- VP1: WEAK VIBRATION PULSE
- DUM1, DUM2: DUMMY PULSE

FOURTH EMBODIMENT (MULTIPLE DRIVE SIGNALS)

NON MULTI-MAIN SCANNING RECORDING METHOD (s=1)

SCANNING PARAMETER

NOZZLE PITCH: k=3
USED NOZZLE NUMBER: N=4
MAIN SCANNING REPETITION NUMBER: s=1
EFFECTIVE NOZZLE NUMBER: Neff=4

| PATH NUMBER | 1 | 2 | 3 | 4 |
|---|---|---|---|---|
| FEED AMOUNT L [PIXEL] | 0 | 4 | 4 | 4 |
| ΣL | 0 | 4 | 8 | 12 |
| F=(ΣL) %k | 0 | 1 | 2 | 0 |

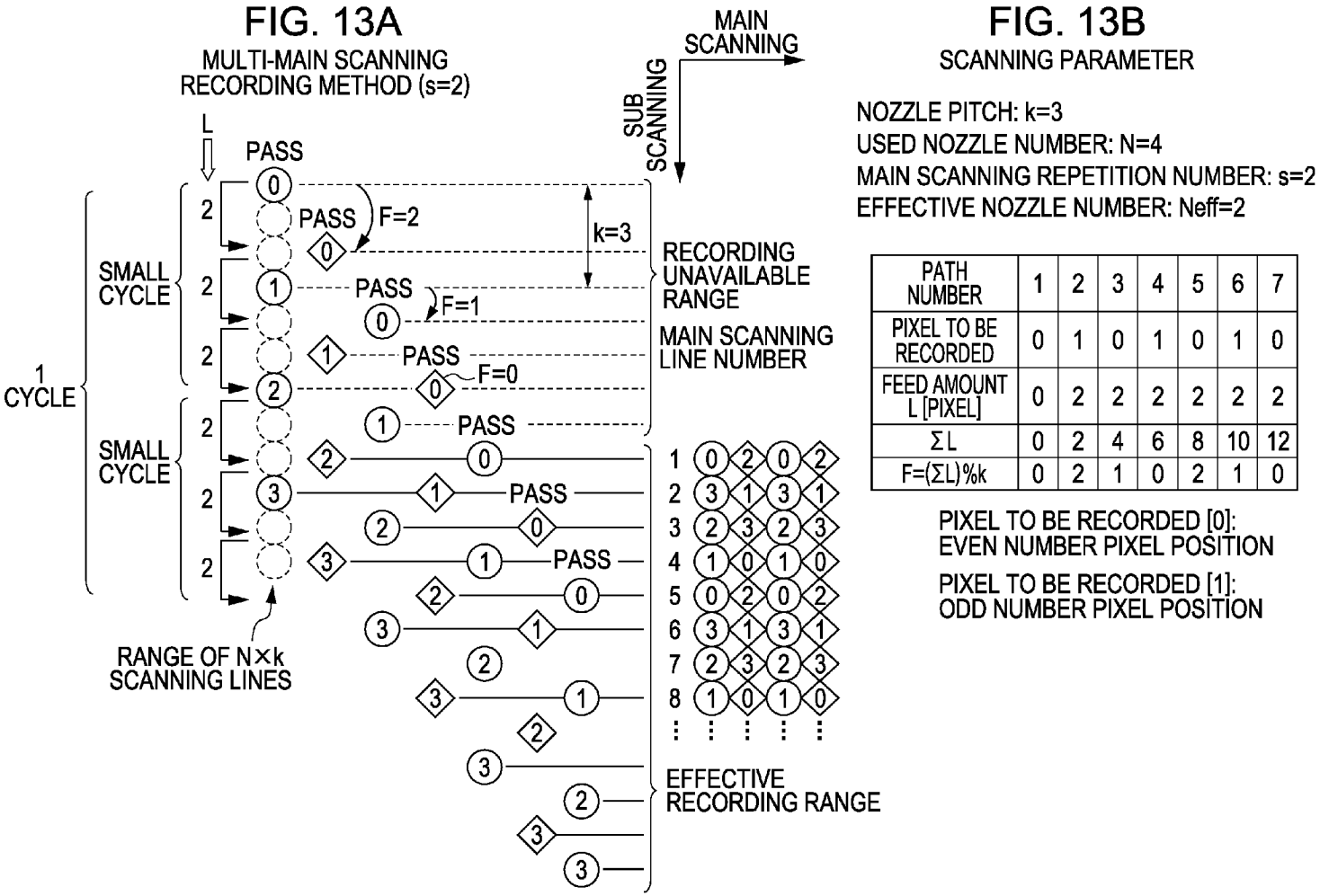
| PATH NUMBER | 1 | 2 | 3 | 4 | 5 | 6 | 7 |
|---|---|---|---|---|---|---|---|
| PIXEL TO BE RECORDED | 0 | 1 | 0 | 1 | 0 | 1 | 0 |
| FEED AMOUNT L [PIXEL] | 0 | 2 | 2 | 2 | 2 | 2 | 2 |
| ΣL | 0 | 2 | 4 | 6 | 8 | 10 | 12 |
| F=(ΣL)%k | 0 | 2 | 1 | 0 | 2 | 1 | 0 |

FIFTH EMBODIMENT (MULTI-MAIN SCANNING RECORDING METHOD)

FIG. 15

PRINT MODE TABLE

| SPECIFICATION / MODE | PRINT RESOLUTION (dpi) | MAIN SCANNING REPETITION NUMBER s | MAXIMUM INK AMOUNT | RECIPROCATING MOVEMENT | CARRIAGE VELOCITY |
|---|---|---|---|---|---|
| M1 | 360×360 | ONE TIME | 24 pl | Bi-d | HIGH |
| M2 | | | | Uni-d | |
| M3 | 360×720 | ONE TIME | 24 pl | Bi-d | |
| M4 | | | | Uni-d | |
| M5 | 720×720 | TWO TIMES | 19 pl | Bi-d | |
| M6 | | | | Uni-d | |
| M7 | 1440×720 | TWO TIMES | 8 pl | Bi-d | LOW |
| M8 | | | | Uni-d | |

Bi-d: BI-DIRECTION
UNi-d: UNI-DIRECTION

LIQUID EJECTING APPARATUS AND CONTROL METHOD THEREOF

BACKGROUND

1. Technical Field

The present invention relates to a liquid ejecting apparatus ejecting liquid such as ink and a control method thereof.

2. Related Art

As a typical liquid ejecting apparatus, there is an ink jet printer of a type in which ink is ejected from a nozzle using a piezoelectric element. In this type of ink jet printer, an ink chamber is provided in each nozzle and the ink is ejected from the nozzle by changing the volume of the ink chamber by driving the piezoelectric element. Hereinafter, the ink jet printer is referred to as "a piezoelectric type ink jet printer". In the piezoelectric type ink jet printer, it has been known that if the ink is continuously ejected, there is a rise in the temperature of the head drive circuit. Thus, research has been done to prevent the head drive circuit from being overheated. For example, in an ink jet printer of JP-A-2009-056669, the temperature of the head drive circuit is estimated without using a temperature sensor and controlled such that the estimated value does not exceed the limit value, it thereby prevents the head drive circuit from being overheated.

The ink jet printer in JP-A-2009-056669 is a printer in which a head drive circuit is provided in a position (a printer main body) away from the print head. The inventors of the present application have found that there is a case where it is not the increase of the temperature in the head drive circuit, but the increase of the temperature in the print head itself that becomes a problem in this type of printer. That is, the inventors have found that in a case of printing onto a large size print sheet (for example, a sheet of A2 size or higher), the temperature of the print head gradually increases due to heating of the piezoelectric element, so there is a concern that the print head becomes overheated.

Further, in the ink jet printer, it has been desired to stabilize the meniscus of the nozzle or suppress the viscosity of the ink by contriving the waveform of a drive signal (for example, JP-A-2008-044233).

In addition, as shown in FIG. 5 of JP-A-2009-056669, there is a case of using a drive signal including a plurality of drive waveform parts from the related art. If one of a plurality of drive waveform parts is selected and applied to the piezoelectric element, then the residual vibration of the piezoelectric element will be continued to some extent. There is a problem that if the next drive waveform part is applied to the piezoelectric element while the residual vibration exists, a correct amount of ink cannot be ejected.

Further, in the respective ink jet printers, it has been desired to realize a proper ink ejection amount and proper dot formation position according to the characteristics thereof. For example, even in the same type of ink jet printers, research has been desired to realize the proper ink ejection amount and the proper dot formation position for the respective printers according to the manufacture error for the respective printers.

Otherwise, even in the same type of ink jet printer, research has been desired to realize the proper ink ejection amount and the proper dot formation position according to various print modes and print operations (for example, at a time of forward movement and at a time of rearward movement) (for example, JP-A-2003-266700).

In other ink jet printers in the related art, it has been desired to achieve improvement of image quality, longer life spans of components, power saving and stabilization of the circuit operation.

In addition, the aforementioned various problems are not limited to the ink jet printer, but are common to the liquid ejecting apparatus having a head that ejects liquid using the piezoelectric element.

SUMMARY

The invention can be realized in the following aspects.

(1) According to an aspect of the invention, there is provided a liquid ejecting apparatus. The liquid ejecting apparatus includes a drive signal generation section which generates a drive signal having at least one or more waveform parts; and a liquid ejecting head which applies at least a part of the drive signal to a piezoelectric element and causes a nozzle to eject droplets. The drive signal is a periodic signal. One period of the drive signal has two durations of (i) a droplet ejection duration with a waveform part used to eject the droplet from the nozzle and (ii) a droplet non-ejection duration without the waveform part used to eject the droplet from the nozzle. The droplet non-ejection duration is equal to or longer than the droplet ejection duration.

In this case, the droplet non-ejection duration of the drive signal is equal to or longer than the droplet ejection duration, thus the rise in the temperature of the liquid ejecting head is suppressed compared to a case where the droplet non-ejection duration is short, it thereby prevents the liquid ejecting head from being overheated.

(2) In the liquid ejecting apparatus, the droplet non-ejection duration may have a length of 1.5 times or more the droplet ejection duration.

In this case, the rise in the temperature of the liquid ejecting head is further suppressed, it thereby prevents more reliably the liquid ejecting head from being overheated.

(3) In the liquid ejecting apparatus, the droplet ejection duration may be one continuous time duration with the waveform part used to eject the droplet from the nozzle, and the droplet non-ejection duration may be a time duration without the waveform part used to eject the droplet from the nozzle.

In this case, it is possible to prevent reliably the liquid ejecting head from being overheated.

(4) In the liquid ejecting apparatus, the droplet ejection duration may be a time duration with the waveform part used to eject the droplet from the nozzle, and the droplet non-ejection duration may be one continuous time duration without the waveform part used to eject the droplet from the nozzle.

In this case, it is possible to reliably prevent the liquid ejecting head from being overheated.

(5) In the liquid ejecting apparatus, the droplet ejection duration may be one continuous time duration with the waveform part used to eject the droplet from the nozzle, and the droplet non-ejection duration may be one continuous time duration without the waveform part used to eject the droplet from the nozzle.

In this case, it is possible to reliably prevent the liquid ejecting head from being overheated.

(6) In the liquid ejecting apparatus, the droplet ejection duration may include a plurality of the waveform parts used to eject the droplet from the nozzle.

In this case, it is possible to reliably prevent the liquid ejecting head from being overheated.

(7) In the liquid ejecting apparatus, the droplet non-ejection duration may include a dummy waveform part in which if the dummy waveform part is applied to the piezoelectric element, the droplet is ejected from the nozzle, but the dummy waveform part is not actually applied to the piezoelectric element.

In this case, the dummy waveform part is not actually applied to the piezoelectric element, so even if the droplet non-ejection duration includes the dummy waveform part, it thereby more reliably prevents the liquid ejecting head from being overheated.

(8) In the liquid ejecting apparatus, the droplet non-ejection duration may include a waveform part in which even if the waveform part is applied to the piezoelectric element, the droplet is not ejected from the nozzle.

In this case, it is possible to reliably prevent the liquid ejecting head from being overheated.

(9) In the liquid ejecting apparatus, the lengths of the droplet ejection duration and the droplet non-ejection duration may be set such that the maximum ejection amount of the droplet per unit time from the nozzle is less than 6000 picoliter/second.

In this case, if the ejection amount of the droplet from the nozzle is large, the rise in the temperature of the liquid ejecting head is significant. However, if the maximum ejection amount of the droplet per unit time is limited to be less than 6000 picoliter/second, it is possible to reliably prevent the liquid ejecting head from being overheated.

(10) In the liquid ejecting apparatus, the drive signal generation section (a) may generate only one drive signal and supply the drive signal to the liquid ejecting head, or (b) may simultaneously generate a plurality of drive signals and supply the drive signals to the liquid ejecting head, and the droplet ejection duration and the droplet non-ejection duration may be determined from all the plurality of drive signals.

In this case, when only one drive signal is supplied to the liquid ejecting head, or even in a case where a plurality of drive signals are supplied to the liquid ejecting head, it is possible to reliably prevent the liquid ejecting head from being overheated.

Another aspect of the invention can be realized as an apparatus with one or more elements among two elements of a signal generation section which generates a drive signal and a head. That is, the apparatus may have or may not have the signal generation section. Further, the apparatus may have or may not have the head. The drive signal that the signal generation section generates may be a periodic signal or a non-periodic signal. One period of the drive signal may be configured to include two durations of the droplet ejection duration and the droplet non-ejection duration, or may be configured to include other durations. The droplet ejection duration may be a time duration with the waveform part used to eject the droplet from the nozzle, or a time duration with the other waveform parts. The droplet non-ejection duration may be a time duration without the waveform part used to eject the droplet from the nozzle, or a time duration with the other waveform parts. The droplet non-ejection duration may be equal to or longer than the droplet ejection duration, but the droplet non-ejection duration may be equal to or shorter than the droplet ejection duration.

The apparatus may be implemented as, for example, a liquid ejecting apparatus, and may be implemented as other apparatuses than the liquid ejecting apparatus. According to the aspects, it is possible to achieve at least one of various advantages such as heating prevention of the head, stabilization of the meniscus of the nozzle, suppression of increase in viscosity of the ink, improvement of image quality, longer life spans of components, power saving and stabilization of the circuit operation. A part or all of the technical characteristics of each of the aforementioned aspects may be applied to the apparatus.

The invention can also be realized in various forms other than the apparatus. For example, it is possible to realize the invention in the form of a liquid ejecting method and a liquid ejecting apparatus, a control method and a control apparatus thereof, a computer program for realizing functions of the methods or the apparatuses, and a non-transitory recording medium recording the computer program.

BRIEF DESCRIPTION OF THE DRAWINGS

The invention will be described with reference to the accompanying drawings, wherein like numbers reference like elements.

FIG. 5 is an explanatory diagram illustrating an example of the relationship between the dot sizes and the selection pulses.

FIGS. 13A and 13B are explanatory diagrams of a multi-main scanning recording method.

FIG. 15 is an explanatory diagram illustrating print modes in the fifth embodiment.

DESCRIPTION OF EXEMPLARY EMBODIMENTS

Various embodiments are described in the following order.

First embodiment: Extension example 1 of ink non-ejection duration

Second embodiment: Extension example 2 of ink non-ejection duration

Third embodiment: Example of ink non-ejection duration including dummy pulse

Fourth embodiment: Example of using multiple drive signals

Fifth embodiment: Example of using drive signals in multi-main scanning recording method

Modification Examples

First Embodiment

Extension Example 1 of Ink Non-Ejection Duration

Figure 1:
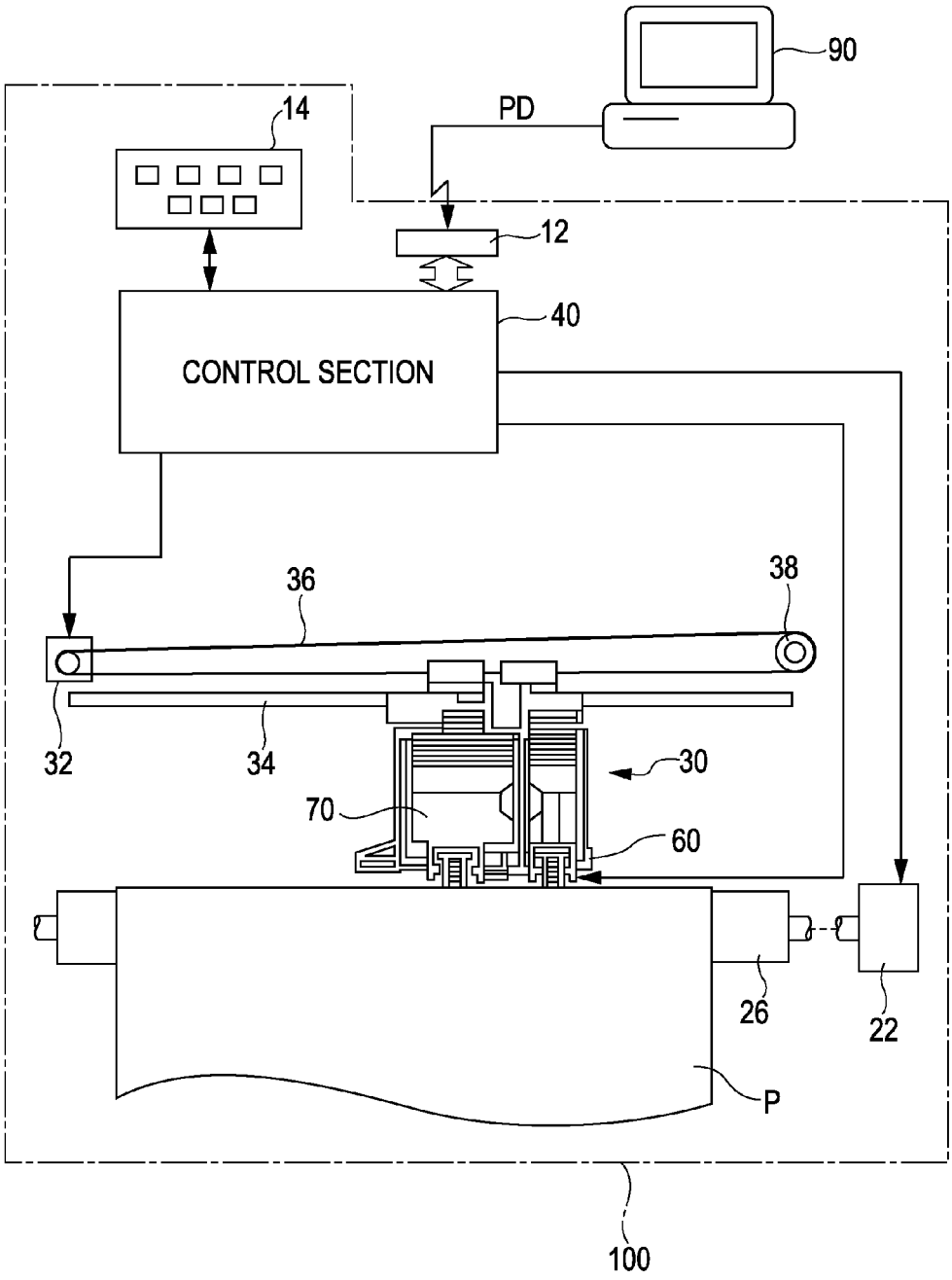
FIG. 1 is an explanatory diagram illustrating the schematic configuration of the print system in an example of the invention.

FIG. 1 is an explanatory diagram illustrating a schematic configuration of a print system according to an embodiment of the invention. The print system of the embodiment includes a printer 100, and a host computer 90 which supplies print data PD to the printer 100. The printer 100 is connected to the host computer 90 through a connector 12.

The printer 100 in the embodiment is an ink jet printer which is a kind of liquid ejecting apparatus which ejects droplets. The printer 100 ejects ink as liquid to form ink dots on a print medium, whereby recording characters, figures, images and the like according to print data PD.

The printer 100 includes a carriage 30 with a print head 60, a main scanning drive mechanism for performing a main scanning operation to cause the carriage 30 to reciprocate along the main scanning direction (the horizontal direction of FIG. 1), a sub-scanning drive mechanism for performing a sub-scanning operation to transport the sheet P as a print medium in the sub-scanning direction crossing the main scanning direction, an operation panel 14 for performing various instruction and setting operations relating to the printing, and a control section 40 for controlling each part of the printer 100. In addition, carriage 30 is connected to the control section 40 through the flexible cable.

When printing is performed by the printer 100, the main scanning operation to eject the ink from the nozzle of the print head 60 while moving the print head 60 in the main scanning direction and the sub-scanning operation to move the relative position of the print head 60 to the print medium in the sub-scanning direction are repeatedly performed.

The main scanning drive mechanism that causes the carriage 30 to reciprocate along the main scanning direction includes a carriage motor 32, a sliding axis 34 that is installed in parallel with the main scanning direction to slidably hold the carriage 30, and a pulley 38. The carriage motor 32 and the pulley 38 are disposed in the vicinity of both edges of the sliding axis 34, and an endless drive belt 36 is stretched between both edges. The carriage 30 is connected to the drive belt 36. If the carriage motor 32 rotates, the drive belt 36 rotates, whereby the carriage 30 moves along the sliding axis 34. In addition, the carriage 30 is movable in both directions of the forward movement and the rearward movement. For example, the forward movement is an operation of the carriage 30 toward the right direction of FIG. 1 and the rearward movement is an operation of the carriage 30 toward the left direction of FIG. 1.

The sub-scanning drive mechanism that transports the sheet P in the sub-scanning direction has a sheet feed motor 22.

The rotation of the sheet feed motor 22 is transferred to the sheet transport roller 26, and the sheet P is transported along the sub-scanning direction by the rotation of the sheet transport roller 26.

The carriage 30 is equipped with a plurality of ink cartridges 70 which each accommodates a predetermined color ink, (for example, cyan (C), light cyan (Lc), magenta (M), light magenta (Lm), yellow (Y) and black (K)). The ink accommodated in the ink cartridge 70 is supplied to the print head 60. The ink cartridge is not necessarily installed in the carriage, but a mechanism may be provided which has a separate mechanism to mount the ink cartridge and in which ink is supplied to the print head installed in the carriage therefrom. The print head 60 includes a plurality of nozzles which eject ink and a piezoelectric element provided corresponding to each nozzle. In the embodiment, the piezoelectric element that is a capacitive load is used as the nozzle drive element. If the drive signal is applied to the piezoelectric element, the vibration plate of the ink chamber communicating with the nozzle is deformed to cause the pressure change in the ink chamber, and the pressure change causes the ink to be ejected from the nozzle. The ejection amount of the ink changes according to the waveform parameters such as the crest value of the drive signal to be applied to the piezoelectric element or the inclination of the voltage change of the drive signal. It is possible to change the size of the ink dot formed on the print medium by changing the waveform parameters. In addition, in the specification, the ink dot is also briefly referred to as "dot."

Figure 2:
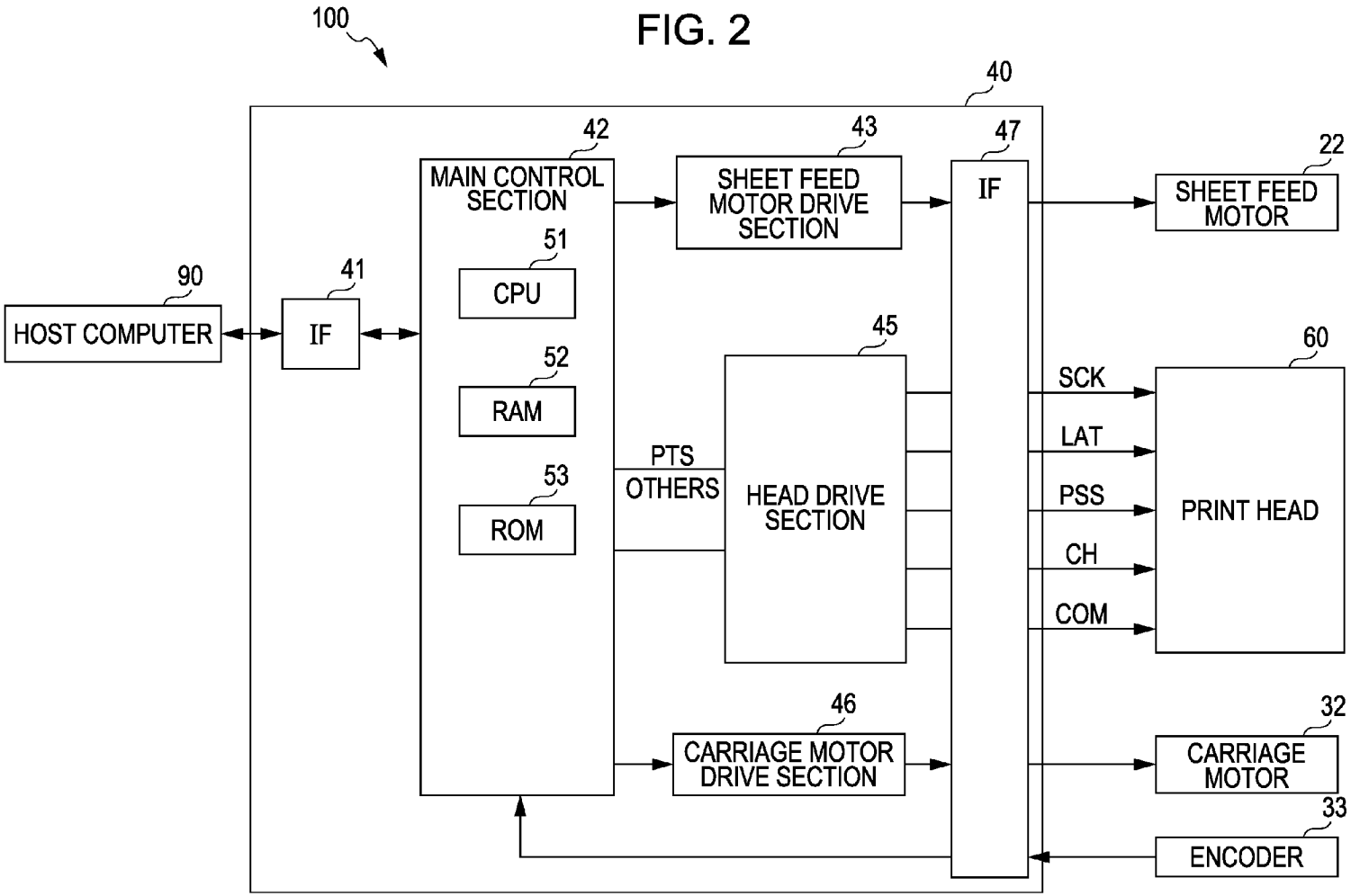
FIG. 2 is a block diagram illustrating the internal configuration of a control section.

FIG. 2 is a block diagram illustrating an internal configuration of the control section 40. The control section 40 includes a first interface 41, a main control section 42 for executing various processes based on the print data PD that is input through the first interface 41, a sheet feed motor drive section 43 for driving a sheet feed motor 22, a head drive section 45 for driving the print head 60, a carriage motor drive section 46 for driving a carriage motor 32 and a second interface 47. Further, the printer 100 includes an encoder 33 which outputs a pulsed output signal to the control section 40 with the movement of the carriage 30. The main control section 42 detects the position along the main scanning direction of the carriage 30, based on the output signal of the encoder 33. In addition, in the specification, the head drive section 45 is also referred to as "the head drive signal generation section." Further, entire control section 40 including three drive sections 43, 45 and 46 is also referred to as "the drive signal generation section."

The main control section 42 includes a CPU 51, a RAM 52, and a ROM 53. The CPU 51 executes the computer program stored in the RAM 52 or the ROM 53, whereby various functions by the main control section 42 are realized.

The main control section 42 receives the print data PD that is input from the host computer 90. The main control section 42 generates various data to be used in order to drive the print head 60 by performing various processes to the print data PD, and outputs the generated data to the head drive section 45. Further, the main control section 42 generates a timing signal PTS for defining the drive timing of the print head 60, based on the output signal from the encoder 33 and supplies the generated signal to the head drive section 45. The head drive section 45, according to the various data and signals that are provided from the main control section 42, generates a control signal including a reference clock signal SCK, a latch signal LAT, a pulse selection signal PSS, a channel signal CH and a drive signal COM, and supplies the control signals to the print head 60. Further, the main control section 42 outputs the signal used in each drive operation with respect to the sheet feed motor drive section 43 and the carriage motor drive section 46. The sheet feed motor drive section 43 outputs a control signal for driving the sheet feed motor 22. The carriage motor drive section 46 outputs a control signal for driving the carriage motor 32.

Figure 3:
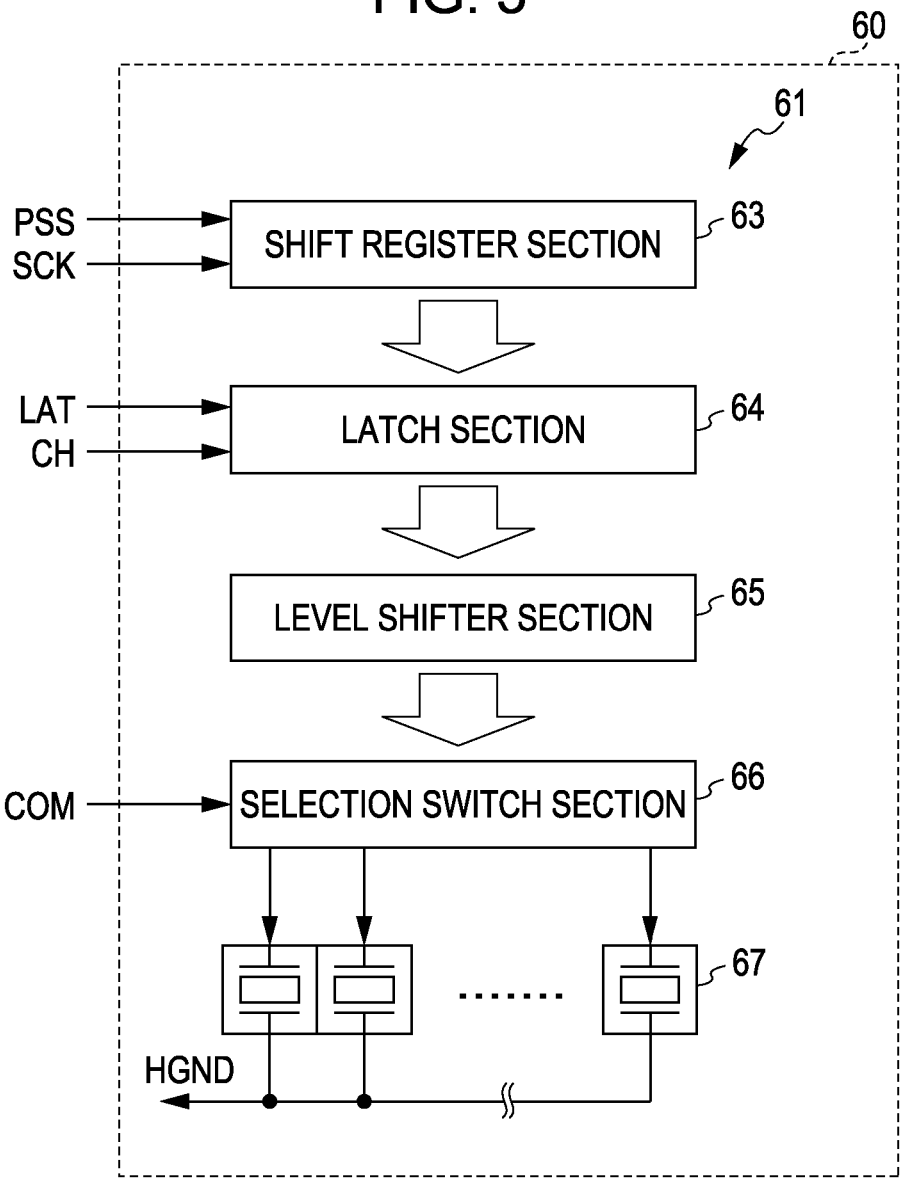
FIG. 3 is a block diagram illustrating the configuration of a switching control section.

FIG. 3 is a block diagram illustrating a configuration of the switching control section 61 provided in the print head 60. The aforementioned various control signals PSS, SCK, LAT, CH and COM are supplied from the head drive section 45 to the switching control section 61. The switching control section 61 includes a shift register section 63 for saving a pulse selection signal PSS, a latch section 64 for temporarily saving the output signal from the shift register section 63, a level shifter section 65 for shifting the voltage level of the output signal from the latch section 64 and supplying to a selection switch section 66, and the selection switch section 66 for selectively supplying the drive signal COM to the respective piezoelectric element 67. The piezoelectric element 67 functions as a nozzle drive element for causing the ink to be ejected from the respective nozzle. In addition, the shift register section 63, the latch section 64, the level shifter section 65 and the selection switch section 66 each includes the circuit components of the same number as the number of the nozzles (that is, the number of the piezoelectric elements 67). For example, in a case where the number of the nozzles that are present in the print head 60 is 100, the shift register section 63 includes one hundred shift registers. Other circuit sections 64, 65 and 66 are also the same as the above case. In addition, hereinafter, respective selection switches included in the selection switch section 66 may be referred to as the selection switch section 66, denoted by the same reference numeral "66" as "the selection switch 66."

The pulse selection signal PSS for each nozzle is input to and stored in the shift register section 63. After that, in response to the input pulse of the reference clock signal SCK, the memory position of the pulse selection signal PSS in the shift register section 63 is sequentially shifted to the later stage. The pulse selection signal PSS is a signal to be used in order to determine which pulses among a plurality of pulses included in the drive signal COM are applied to respective piezoelectric elements 67. As described later, if a part or all of ink ejecting pulses of the drive signal COM are applied to the piezoelectric element 67 in response to the pulse selection signal PSS, it is possible to cause any one of ink droplet among a plurality of ink droplets of different ink amounts to be ejected from the nozzle. The latch section 64 sequentially latches the output signals of the shift register section 63 at a pulse generation timings of the latch signal LAT and the channel signal CH. The latch signal LAT is a signal having a high level at the start timing of one pixel of a recording operation. The channel signals CH are signals each having a high level at predetermined timings in switching ON/OFF of a respective pulse included in the drive signal COM. The signal latched in the latch section 64 is converted to the voltage level (ON level or OFF level) to make the selection switch 660N state or OFF state by the level shifter section 65.

The output signal of the level shifter section 65 is supplied to the control terminal of the corresponding selection switch 66, to turn respective selection switch 66 ON or OFF. From the selection switch 66 turned ON like the above, the drive signal COM is supplied to the piezoelectric element 67 connected to the selection switch 66. On the other hand, from the selection switch 66 turned OFF, the drive signal COM is not supplied to the piezoelectric element 67 connected to the selection switch 66. In addition, even after the selection switch 66 is turned OFF, it is preferable that the input voltage (the voltage of the input terminal) of the corresponding piezoelectric element 67 is maintained in the immediately preceding voltage. The reference numeral HGND in FIG. 3 is a ground terminal of the piezoelectric element 67. In the specification, the drive signal COM can be commonly used in a plurality of piezoelectric elements 67, thus is also referred to as "common drive signal COM."

Figure 4:
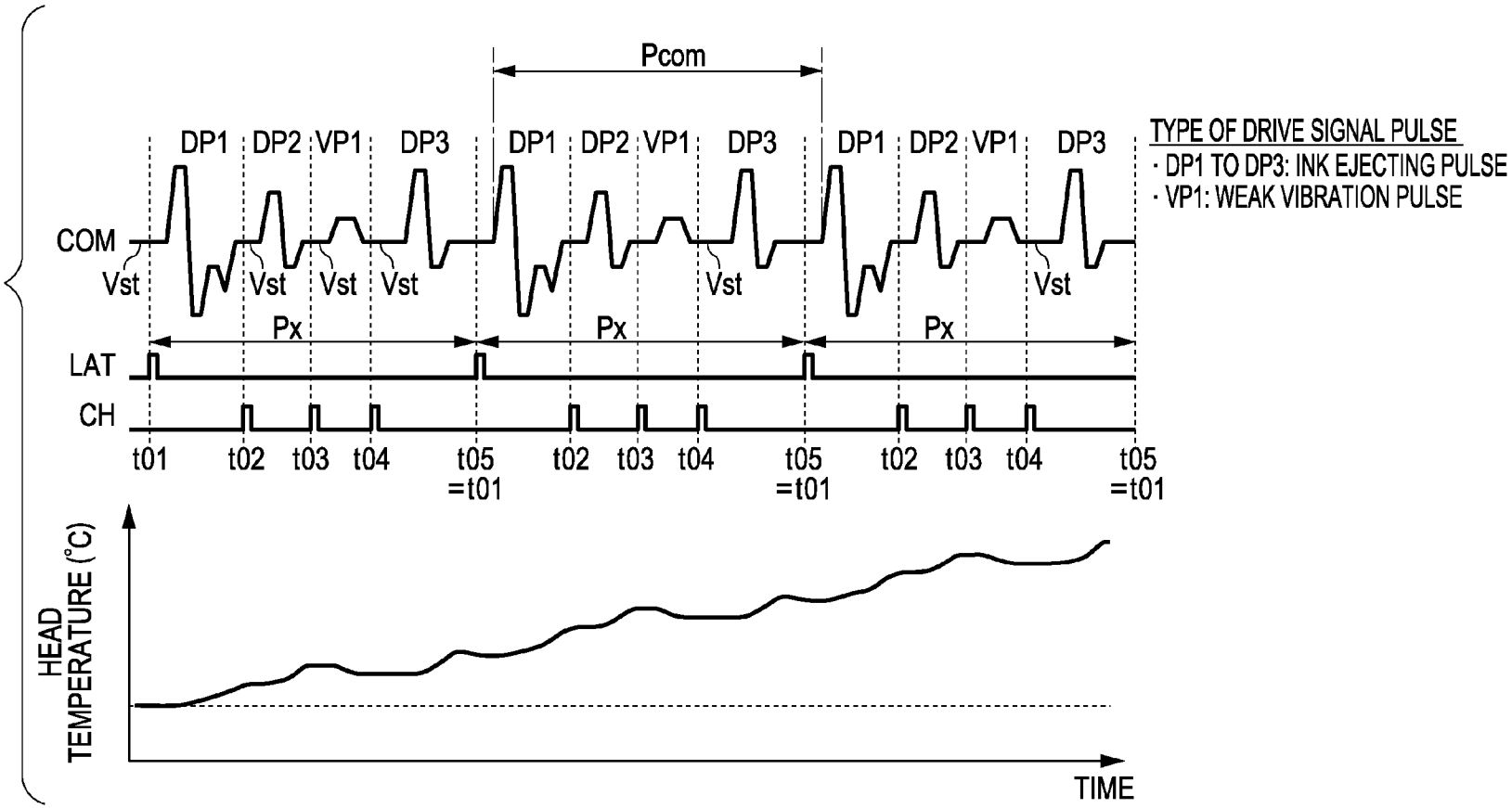
FIG. 4 is a timing chart illustrating the waveform of the drive signal of a reference example.

FIG. 4 is an explanatory diagram illustrating an example of the control signals COM, LAT and CH to be supplied to the print head 60 in a reference example. The latch signal LAT is a signal in which one pulse is generated at a start timing t01 of one pixel (a print pixel). The period that is defined in the pulse of the latch signal LAT is also referred to as "a pixel period Px." The drive signal COM includes a plurality of pulses DP1, DP2, VP1 and DP3 in each pixel period Px. In other parts than these pulses DP1, DP2, VP1 and DP3, the drive signal COM is maintained in the preset steady potential Vst. Three pulses DP1, DP2 and DP3 among four pulses generated in one pixel period Px is one unit waveform part to be used in order to drive the piezoelectric element 67 and eject the ink from the nozzle. These pulses DP1, DP2 and DP3 are referred to as "the ink ejecting pulse." In addition, "the waveform part" means a part of the drive signal COM and a part including the voltage change. Further, "pulse" means one continuous waveform part which includes at least the duration when the voltage level of the drive signal COM changes and may include the duration when the voltage level is maintained in the level different from the steady potential Vst. The "pulse" is also referred to as "a changing waveform part" or "a changing part."

Even if pulse VP1 of FIG. 4 is applied to the piezoelectric element 67, ink is not ejected from the nozzle, but the pulse VP1 is a pulse for giving weak vibration to the meniscus of the nozzle. This weak vibration pulse VP1 is used to improve the state of the meniscus of the nozzle. For example, the weak vibration pulse VP1 gives weak vibration to the meniscus, thereby being used for the purpose of improving the characteristic of the ink ejection from the nozzle thereafter. Alternatively, the weak vibration pulse VP1 gives weak vibration to the meniscus and facilitates the flow of the ink in the meniscus and the ink chamber, thereby being used for the purpose of preventing the degree of viscosity of the ink from being excessively increased. In addition, like the weak vibration pulse VP1, a pulse, that even if the pulse alone is applied to the piezoelectric element 67, the ink is not ejected from the nozzle, is also called as "ink non-ejecting pulse".

Each of pulses DP1, DP2, VP1, and DP3 that are included in the drive signal COM is configured by one waveform part which changes to show waveform such as a substantially trapezoidal shape, substantially a mountain shape, substantially a valley shape, and the like from a predetermined steady potential Vst and returns to the steady potential Vst. In duration before each pulse and duration after each pulse, the voltage level of the drive signal COM is maintained in the steady potential Vst.

In addition, in the specification, the phrase "drive signal COM is maintained in the steady potential Vst" means that a slight change due to a noise or an error is allowed, but the level of the drive signal COM does not substantially (significantly) change from the potential Vst. "The steady potential Vst" is also referred to as "a middle potential Vst."

Although it depends on the structure of the ink chamber, for example, the rising edge part of each pulse expands the volume of the ink chamber communicating with the nozzle and the falling edge part of each pulse reduces the volume of the ink chamber, whereby the ink is pressed out of the nozzle. Therefore, ink ejecting pulses DP1, DP2 and DP3 are applied to the piezoelectric element 67, whereby ink is ejected from the nozzle, and the ink dots are formed in the pixel position on the print medium. On the other hand, since the voltage change in the weak vibration pulse VP1 is equal to or smaller than the ink ejecting pulse, even if the weak vibration pulse VP1 is applied to the piezoelectric element 67, the ink is not ejected from the nozzle.

In the drive signal COM, the waveforms (inclinations of the voltage changes or the crest values) of ink ejecting pulses DP1, DP2, and DP3 are different from each other. If the waveforms of the ink ejecting pulses are different, the ejection amounts (that is, the sizes of the ink dots to be formed on the print medium) of the ink are different. Therefore, in respective pixel period Px, one or a plurality of pulses among the ink ejecting pulses DP1, DP2 and DP3 are selected and supplied to the piezoelectric element 67, thereby ejecting a desirable amount of ink from the nozzle. Whether or not the ink is ejected from the nozzle can be determined by examining whether the ink dots have been formed on the print medium. In addition, "the crest value" of some waveform parts mean both maximum value and minimum value of the voltage in the waveform part. As an example of the pulses DP1, DP2 and DP3, a plurality of crest values may exist in one pulse. Among both maximum value and minimum value of the voltage in some waveform parts, the voltage, that the difference from the steady potential Vst is the largest, is also referred to as "peak voltage."

FIG. 5 is an explanatory diagram illustrating an example of the relationship between the dot sizes and the selection pulses. In the example, the relationship among the pixel gradation value of the print data, the value of the pulse selection signal PSS, the dot size and the pulse selected are shown. The pixel gradation value is expressed as 2 bits of a binary number, and the value of the pulse selection signal PSS is expressed as 4 bits of a binary number. The conversion from the pixel gradation value to the pulse selection signal PSS is performed by the main control section 42 or the head drive section 45, using the conversion table that is prepared in advance. According to the value of the pulse selection signal PSS, a part of pulses among pulses DP1 to DP3, and VP1 of the drive signal COM in FIG. 4 are selected and supplied to the piezoelectric element 67. As a result, the dot size is classified into four kinds of dot sizes of non-dot (ink dot is not formed), a small dot, a middle dot and a large dot. Three kinds of dot sizes of the small dot, the middle dot and the large dot have different ink ejection amounts from the nozzle from each other. For example, the ink ejection amounts for the small dot, the middle dot and the large dot are respectively 8 picoliter, 19 picoliter and 24 picoliter. FIG. 5 is only an example, in order to form various sizes of ink dots according to the printer type, the shape or the number of the pulses of the drive signal COM can be set. Further, if two or more ink ejecting pulses (for example, pulses DP1 and DP2) are selected within one pixel period Px, it is possible to form larger dots. In addition, in the example of FIG. 5, in a case of non-dot, the weak vibration pulse VP1 is selected and supplied to the piezoelectric element 67, but instead of this, in a case of non-dot, any pulse may not be selected and any pulses may not be supplied to the piezoelectric element 67.

Returning to FIG. 4, the latch signal LAT is a signal to be high level at a start timing t01 in one pixel period Px. Whether or not the first pulse DP1 of the drive signal COM is supplied to the respective piezoelectric elements 67 is determined according to the level (high or low) of the pulse selection signal PSS to be latched to the latch section 64 (FIG. 3) at the timing t01. On the other hand, the channel signal CH is a signal to be high at each of the timings t02, t03 and t04 in order to show the timings t02, t03 and t04 for determining whether or not the second and the subsequent pulses DP2, VP1 and DP3 are used. Whether or not the second and the subsequent pulses DP2, VP1 and DP3 are supplied to the respective piezoelectric element 67 is determined according to the level of the pulse selection signal PSS to be latched to the latch section 64 at the timings t02, t03 and t04. In addition, the termination timing t05 of one pixel period Px is the start timing t01 of the next pixel period Px. The drive signal COM of FIG. 4 includes four pulses DP1, DP2, VP1 and DP3 that can be supplied to the piezoelectric element 67 within one pixel period Px, thus a total of four pulses of one pulse of the latch signal LAT and three pulses of the channel signal CH are used as a pulse to define the timing for determining whether or not these four pulses are used. Further, the pulse selection signal PSS (FIG. 5) is also four bits of signal corresponding to the four pulses.

With the observation of FIG. 4, aside from the pixel period Px, it is possible to recognize the period Pcom of the drive signal COM. As shown in the upper part of FIG. 4, drive signal period Pcom is defined as the time duration that the time when the voltage level is started to change from the steady potential Vst is regarded as the start point, and the pixel period Px and the length thereof are the same. The drive signal COM is a periodic signal that repeatedly generates the same waveform for each period Pcom. Hereinafter, the period Pcom is also referred to as "drive signal period Pcom." However, in a case of observing only the drive signal COM, the start point of the drive signal period Pcom may be arbitrarily taken in any timing. For example, it is possible to define the time when the change in the voltage level is terminated and the voltage level returns to the steady potential Vst in any pulse as the start point of the drive signal period Pcom. However, in the example of FIG. 4, the time when the voltage level is started to change from the steady potential Vst in the first pulse DP1 is defined as the start point of the drive signal period Pcom.

Incidentally, if the head is driven using the drive signal COM shown in FIG. 4, the following problems may occur. In the lower part of FIG. 4, the temporal change in the head temperature of the print head 60 (FIG. 2) is shown. In the example of FIG. 4, since the pixel period Px (and the drive signal period Pcom) is relatively short, the head temperature rapidly rises with the passage of time. The increased rate of the head temperature becomes significant as the pixel period Px is shorter, and the larger the width of the print medium along the scanning direction (the width of the main scanning direction), the higher the maximum value of the head temperature. For example, in a case of performing printing on the large-sized print medium of A2 or higher, the head temperature excessively increases, so that the life of the print head may be shortened and the print head may be damaged. In the worst condition where especially the environmental temperature of the printer is high and large dots are continuously formed during one main scanning, the overheating of the print head becomes the problem. In addition, the higher the main scanning velocity (that is, the carriage velocity) of the print head 60, the shorter the pixel period Px. Therefore, the problem of the overheating of the print head becomes significant, as the main scanning velocity of the print head 60 is higher. In various embodiments described below, it is possible to solve the problem of the overheating of the print head. In addition, "one time main scanning" means an operation to continuously or intermittently move the print head relative to the print medium along the same direction of either one of the forward movement direction and the rearward movement direction. Here, "continuously" means that the movement is performed without interruption, and "intermittently" means that the movement and the stop are alternately performed. In general, the movement of the main scanning is performed continuously, but may be performed intermittently. Further, the phrase "move the print head relative to the print medium" is not limited to a case of moving the print head, but includes a case of moving the print medium.

Figure 6:
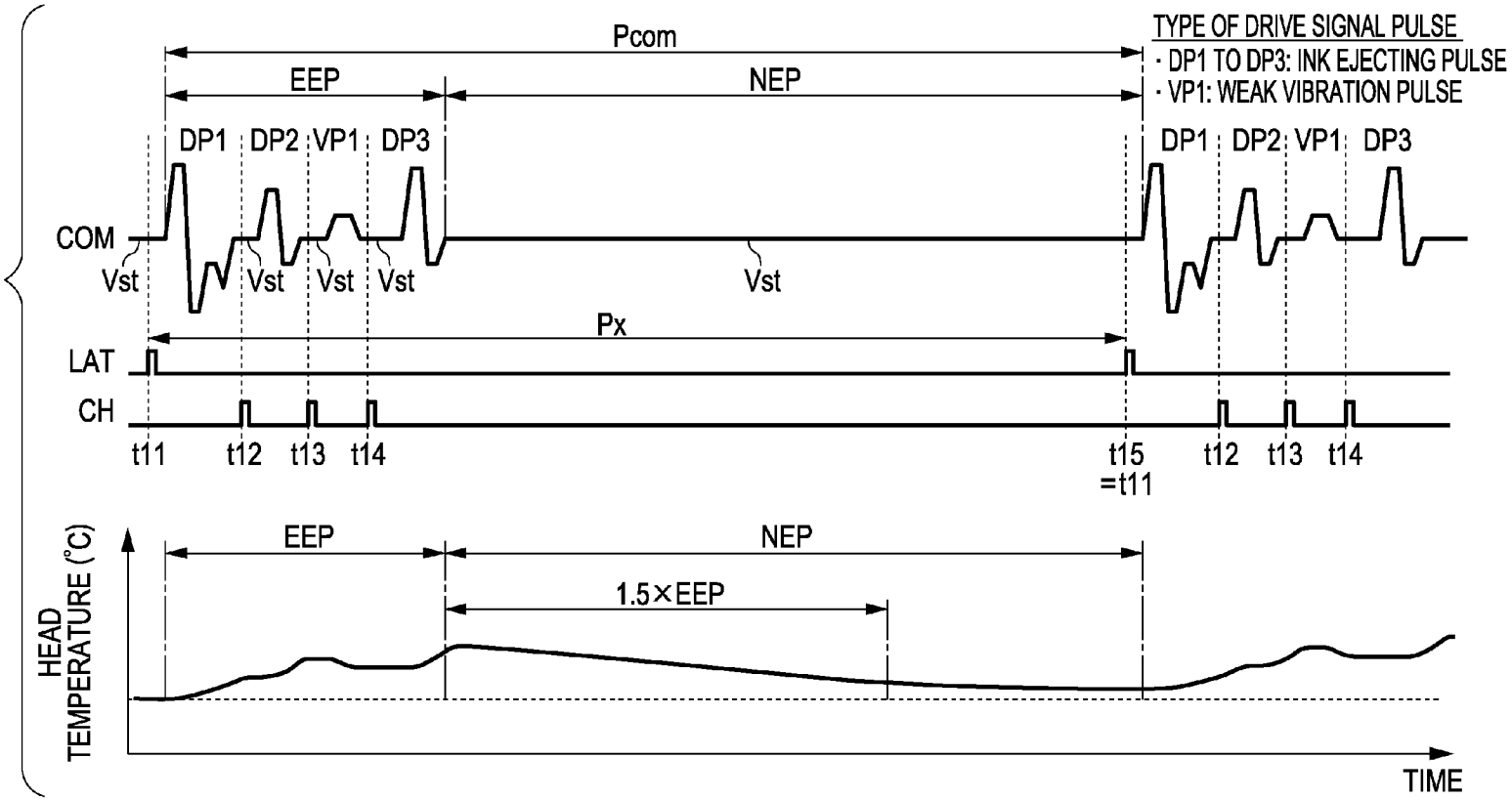
FIG. 6 is a timing chart illustrating the waveform of the drive signal of a first embodiment.

FIG. 6 is a timing chart illustrating the waveform of the drive signal of a first embodiment. The waveforms of three ink ejecting pulses DP1, DP2 and DP3 and one weak vibration pulse VP1 included in the drive signal COM of FIG. 6 are the same as FIG. 4. Further, the correlation relationship between the pulses DP1, DP2, VP1 and DP3 and the positions of the timings t11, t12, t13 and t14 are the same as FIG. 4. Further, the relationship shown in FIG. 5 is established in the same manner.

One of the big differences between FIG. 6 and FIG. 4 is that in FIG. 6, the drive signal period Pcom and the pixel period Px are significantly extended compared to FIG. 4. More specifically, in the drive signal COM of FIG. 6, the duration NEP when the last ink ejecting pulse DP3 returns to the steady potential Vst and then is maintained in the steady potential Vst is significantly long compared to FIG. 4. Since the duration NEP does not include ink ejecting pulses to be used to eject the ink from the nozzle, the duration NEP can be referred to as "ink non-ejection duration NEP." Further, one continuous time duration EEP from the start timing of the first ink ejecting pulse DP1 of one drive signal period Pcom to the termination timing of the last ink ejecting pulse DP3 can be referred to as "ink ejection duration EEP." In addition, it is preferable that the pulse that makes ink ejection duration EEP shortest is selected as "the first ink ejecting pulse of one drive signal period Pcom." For example, in an example of FIG. 6, if it is assumed that the start timing of the second ink ejecting pulse DP2 is selected as the start timing of the ink ejection duration EEP, the ink ejection duration EEP becomes an extremely long duration range from the start timing of the second ink ejecting pulse DP2 to the termination timing of the first ink ejecting pulse DP1 in the next pixel period Px. On the other hand, as shown in FIG. 6, if the start timing of the first ink ejecting pulse DP1 is selected as the start timing of the ink ejection duration EEP, the ink ejection duration EEP becomes equal to or shorter than a case of selecting the start timing of other ink ejecting pulse DP2 or DP3.

The total length of one ink ejection duration EEP and one ink non-ejection duration NEP is the same as the drive signal period Pcom. In this manner, in FIG. 6, each period Pcom of the drive signal COM is divided into two durations of one continuous ink ejection duration EEP and one continuous ink non-ejection duration. In addition, ink ejection duration EEP is also referred to as "first duration" and the ink non-ejection duration NEP is also referred to as "second duration."

Generally speaking, the ink ejection duration EEP is one continuous time duration including all ink ejecting pulses of M (M is an integer of one or more) included in one drive signal period Pcom. Otherwise, the ink ejection duration EEP may be considered to be one continuous time duration from the start timing of the first ink ejecting pulse to the termination timing of the last ink ejecting pulse among the pulses of M. On the other hand, the ink non-ejection duration NEP is one continuous time duration except for the ink ejection duration EEP in one drive signal period Pcom. Otherwise, the ink non-ejection duration NEP may be considered to be the longest duration among the durations without ink ejecting pulse. In addition, the number M of the ink ejecting pulse included in one drive signal period Pcom may be one. However, in a typical example, M is an integer of 2 or more.

In addition, the definitions of the terms relating to the waveform of the drive signal that has been described above are as follows:

(1) "waveform part" is a part of the drive signal COM, and means a part including the voltage change.

(2) "pulse" means one continuous waveform part that does not include the duration that is maintained in the steady potential Vst, but includes at least the duration when the voltage level of the drive signal COM changes, and may include the duration that the voltage level is maintained in the different level from the steady potential Vst.

(3) "ink ejecting pulse" is a pulse to be used in order to eject the ink from the nozzle.

(4) "ink non-ejecting pulse" is a pulse that even if the pulse alone is applied to the piezoelectric element, the ink is not ejected from the nozzle.

(5) "crest value" of some waveform parts means both the maximum value and the minimum value of the voltage in the waveform.

(6) "peak voltage" of some waveform parts means the voltage of which the difference from the steady potential Vst is the largest, among the maximum value and the minimum value of the voltage in the waveform.

(7) "pixel period Px" means the time duration corresponding to one print pixel.

(8) "drive signal period Pcom" is the time duration that the time when the voltage level is started to change from the steady potential Vst or the time when the change in the voltage level is terminated and the voltage level returns to the steady potential Vst is regarded as the start point, and the pixel period Px and the length thereof are the same.

(9) "ink non-ejection duration NEP" is the longest duration in one continuous time duration without the ink ejecting pulse within one drive signal period Pcom.

(10) "ink ejection duration EEP" is one continuous time duration except for the ink non-ejection duration NEP within one drive signal period Pcom. In general, ink ejection duration EEP is one continuous time duration from the start timing of the first ink ejecting pulse to the termination timing of the last ink ejecting pulse among the ink ejecting pulses of M (M is an integer of 1 or more) included in one drive signal period Pcom.

In the lower part of FIG. 6, the temporal change in the head temperature in the first embodiment is illustrated. In the drive signal COM, since the ink non-ejection duration NEP is long, the print head 60 is cooled in the duration NEP and the head temperature does not rise excessively. Therefore, even if being printed on large-sized print medium (for example, the print sheet of A2 size or higher), it is possible to prevent the print head 60 from being overheated. In this context, it is preferable to set the ink non-ejection duration NEP equal to or longer than the ink ejection duration EEP. In addition, according to the trial calculation by the inventors of the present application, it is more preferable to set the ink non-ejection duration NEP to 1.5 times or more the ink ejection duration EEP, from the point that it is possible to prevent the print head 60 from being overheated even under the severe condition. However, with the extension of the ink non-ejection duration NEP, the main scanning velocity (carriage velocity) of the print head 60 is reduced.

In the print medium (for example, the print sheet of A3 size or less) of which the width in the main scanning direction is not as large as that, the temperature of the print head 60 is not as high as that. Therefore, in this case, it is possible to use the drive signal that the ink non-ejection duration NEP is shorter than FIG. 6, and the drive signal shown in FIG. 4. That is, in a case of printing using the print medium of which the width in the main scanning direction is a constant value or less, the ink non-ejection duration NEP may be set equal to or shorter than the ink ejection duration EEP.

Incidentally, it is preferable to use the drive signal COM having the same period Pcom throughout the duration of one main scanning across the width of the main scanning of the print medium, as the drive signal COM. However, in different main scanning, the drive signal periods Pcom may be set to different lengths. For example, in the even number main scanning and the odd number main scanning, the drive signal periods Pcom may be set to different lengths. In addition, throughout all durations of the print process on one sheet of print medium, it is preferable to use a drive signal COM having sufficiently long and same period Pcom. In this manner, even if the head temperature gradually rises during the continuous print operation, it is possible to prevent the head temperature from being excessively raised. In addition, if the length of the drive signal period Pcom is changed, the formation position of the dot is also changed, thereby causing degradation in the image quality. From this view point, it is preferable that the length of the drive signal period Pcom is maintained constant throughout the duration of at least the respective main scanning, and it is more preferable that the length is maintained constant throughout all durations of the print process on one sheet of print medium.

In addition, with respect to the kind or the number of the pulse included in one pixel period Px of the drive signal COM, other pulses than the example of FIG. 6 may be adopted. For example, the number of the pulse included in one pixel period Px of the drive signal COM may be one. However, if the number of the ink ejecting pulses included in one pixel period Px of the drive signal COM is set to two or more, it is possible to form different dots of two kinds or more, and thus it is preferable. The total number of the pulses of the timing signals LAT and CH and the generation timings of the pulses are appropriately set according to the number and the position of the pulse of the drive signal COM included in one pixel period Px.

Figure 7:
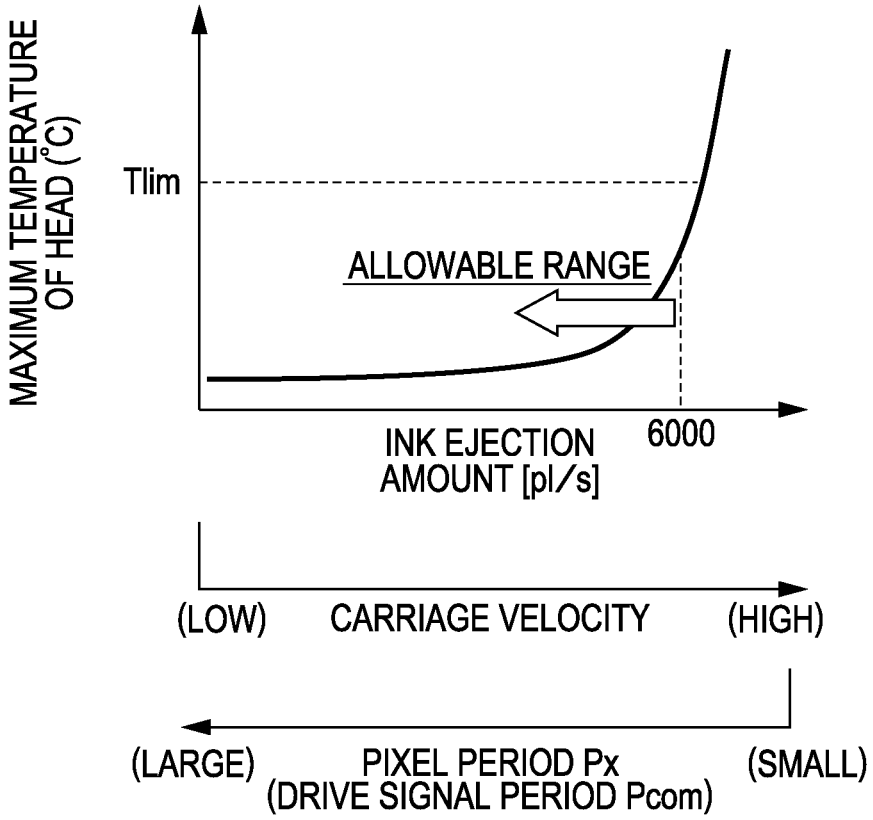
FIG. 7 is a graph illustrating the relationship between the ink ejection amount and the maximum temperature of the head.

FIG. 7 is an explanatory diagram illustrating the relationship between the ink ejection amount and the maximum temperature of the head in the embodiment. The vertical axis represents the maximum temperature that the head temperature can reach in one scanning. The horizontal axis represents an ink ejection amount per unit time [picoliter/second] from a respective nozzle. In addition, as shown below the horizontal axis, the ink ejection amount per unit time is larger as the carriage velocity is higher. Otherwise, the larger the ink ejection amount per unit time, the smaller the pixel period Px (drive signal period Pcom). FIG. 7 illustrates an example of a case of ejecting ink droplets for large dots to all pixels during one main scanning. In general, the larger the amount of the ink droplet, the larger the change in the drive signal COM. Thus, the head temperature greatly rises by the ink ejection. If the carriage velocity is high and the ink ejection amount per unit time exceeds 6000 picoliter/second, there is a concern that the maximum head temperature reaches the upper limit Tlim. Therefore, it is preferable that the maximum ejection amount of the ink per unit time is less than 6000 picoliter/second. This limit can be realized by setting the ratio of the ink non-ejection duration NEP to the ink ejection duration EEP such that the ink non-ejection duration NEP is sufficiently long.

As mentioned above, in the first embodiment, among two durations EEP and NEP constituting the respective drive signal period Pcom, the ink non-ejection duration NEP (second duration) is set to be equal to or longer than the ink ejection duration EEP (first duration), it thereby prevents the head from being overheated.

In addition, various preferable settings and aspects described in the first embodiment may be applied to other embodiments described later.

Second Embodiment

Extension Example 2 of Ink Non-Ejection Duration

Figure 8:
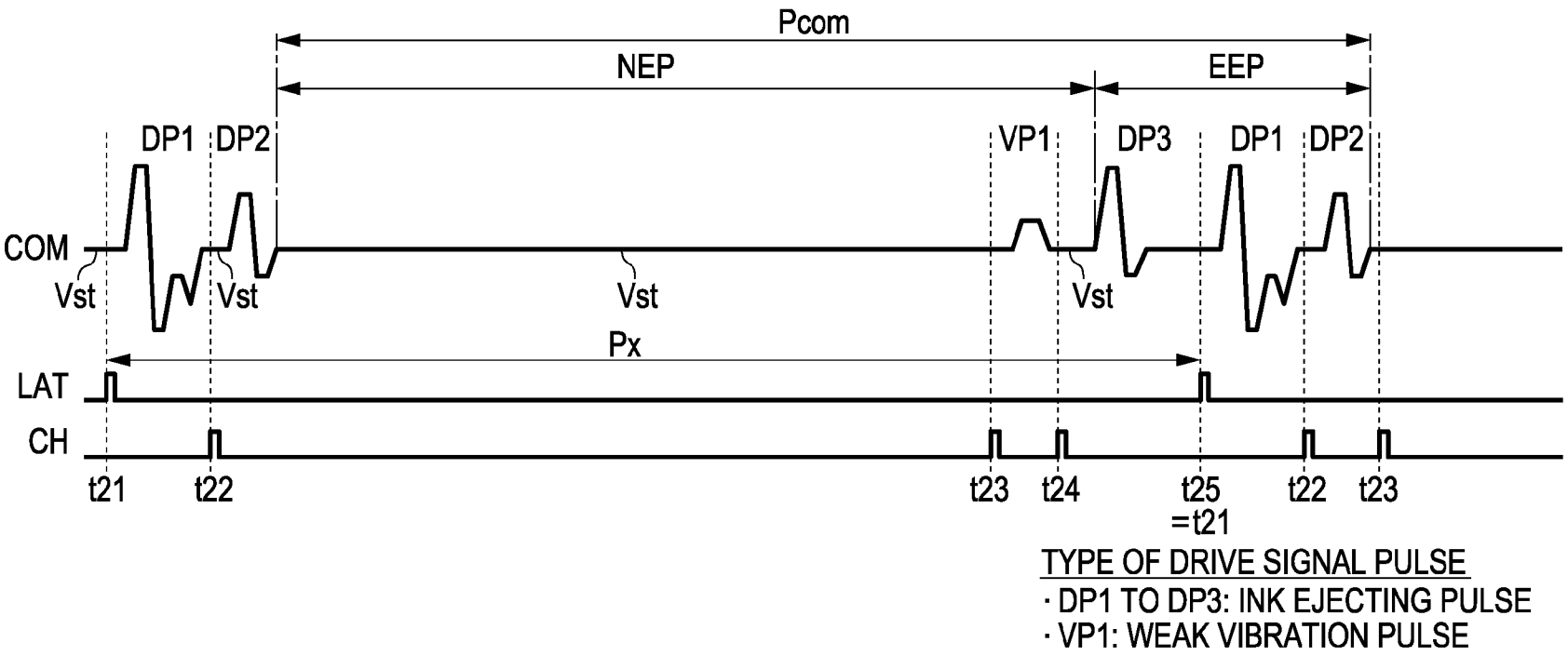
FIG. 8 is a timing chart illustrating the waveform of the drive signal in a second embodiment.

FIG. 8 is a timing chart illustrating the waveform of the drive signal of the second embodiment. The difference between FIG. 8 and FIG. 6 is that the duration between the second ink ejecting pulse DP1 and the weak vibration pulse VP1 in FIG. 8 is extended from FIG. 4, and the shapes of the other signals are almost the same as that of FIG. 6. More specifically, the drive signal COM in FIG. 8 is maintained in the steady potential Vst for a duration equal to or longer than that shown in FIG. 6 after the second ink ejecting pulse DP2 returns to the steady potential Vst, and then the weak vibration pulse VP1 is generated. Further, after the weak vibration pulse VP1, the third ink ejecting pulse DP3 is generated, and successively other ink ejecting pulses DP1 and DP2 are generated. In addition, the timings t21 to t25 for the pulses DP1, DP2, VP1 and DP3 are appropriately changed.

As described above, the weak vibration pulse VP1 is a pulse that even if being supplied to the piezoelectric element 67, the ink is not ejected from the nozzle. Further, as described above, the ink non-ejection duration NEP is defined as the longest duration among durations without ink ejecting pulses. Therefore, in FIG. 8, the weak vibration pulse VP1 is included in the ink non-ejection duration NEP.

As being understood from the first embodiment (FIG. 6) and the second embodiment (FIG. 8), in a case where two or more ink ejecting pulses are included in one drive signal period Pcom, the waveform of the drive signal COM can be set such that the ink non-ejection duration NEP is present between any two ink ejecting pulses among the ink ejecting pulses included in the drive signal COM. Specifically, as the drive signal waveform different from FIG. 6 and FIG. 8, the waveform of the drive signal COM may be set such that the ink non-ejection duration NEP is generated between the first ink ejecting pulse DP1 and the second ink ejecting pulse DP2. Further, the weak vibration pulse may be generated on either side or both sides of the ink ejection duration EEP and the ink non-ejection duration NEP, or not generated at all. In addition, in an example of FIG. 8, similarly to FIG. 6, it is illustrated that the start timing of the pixel period Px is determined by the latch signal LAT, but the start timing of the pixel period Px may be set as other timings (for example, timing t23 or timing t24).

Even in the above second embodiment, among two durations EEP and NEP constituting the respective drive signal period Pcom, the ink non-ejection duration NEP (second duration) is set to be equal to or longer than the ink ejection duration EEP (first duration), it thereby prevents the head from being overheated.

Third Embodiment

Example of Ink Non-Ejection Duration Including the Dummy Pulse

Figure 9:
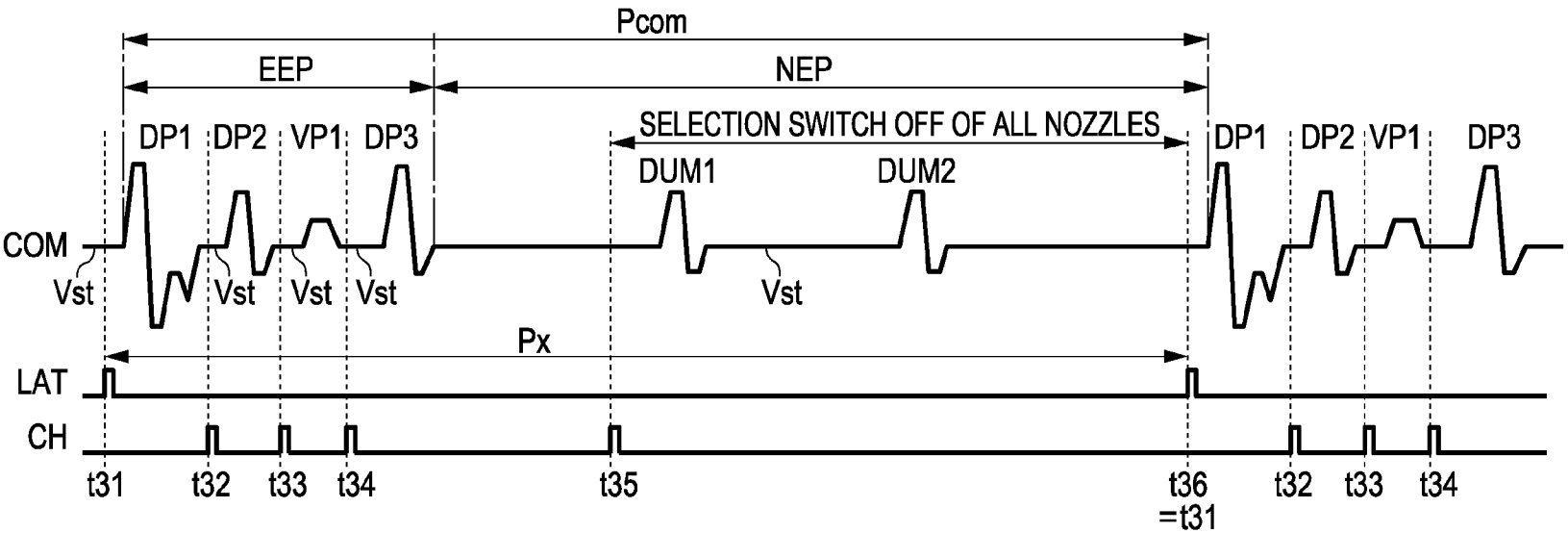
FIG. 9 is a timing chart illustrating the waveform of the drive signal in a third embodiment.

FIG. 9 is a timing chart illustrating the waveform of the drive signal of a third embodiment. The difference between FIG. 9 and FIG. 6 is that the dummy pulses DUM1 and DUM2 are included in the ink non-ejection duration NEP in FIG. 9, and the shapes of other signals are almost the same as FIG. 6. The dummy pulses DUM1 and DUM2 are waveform parts that if being applied to the piezoelectric element 67, the ink is ejected from the nozzle, but the dummy pulses DUM1 and DUM2 are not actually applied to the piezoelectric element 67. The dummy pulse is also referred to as "dummy waveform part." As shown in FIG. 9, within the ink non-ejection duration NEP, in timing t35 before the dummy pulses DUM1 and DUM2 are generated, the pulse of the channel signal CH is generated, and the selection switch of each nozzle is turned OFF in response to the pulse. In addition, in order to turn off the selection switch of each nozzle, it is preferable that one bit of value "0" is added to the last of the pulse selection signal PSS (FIG. 5) relating to all nozzles. In this manner, the dummy pulses DUM1 and DUM2 of the drive signal COM are not actually applied to the piezoelectric element 67 and the ink is not ejected from the nozzle in response to the dummy pulses DUM1 and DUM2. Therefore, the dummy pulses DUM1 and DUM2 are a kind of ink non-ejecting pulses similar to the weak vibration pulse VP1. FIG.

9 is the same as the first embodiment shown in FIG. 6 except for that the dummy pulses DUM1 and DUM2 are added and the pulse (timing t35) of the channel signal CH for the dummy pulse is added. In addition, timings t31 to t34 and t36 in FIG. 9 respectively correspond to timings t11 to t15 in FIG. 6.

For example, there is a possibility that the dummy pulses DUM1 and DUM2 are used in order to maintain the stability of the voltage of the head drive section 45. In normal use state, the current leakage in the head drive section 45 is too small to be negligible. However, under the severe environmental condition of high temperature and high humidity, the current leakage in the head drive section 45 may be considered to increase. In this case, if the static state is maintained without operating the circuit elements in the head drive section 45, there is a possibility that the potential of the drive signal COM is gradually reduced from the steady potential Vst. Therefore, the ink non-ejecting pulse such as the dummy pulses DUM1 and DUM2 are intentionally generated, thereby maintaining the stability of the voltage of the head drive section 45 and preventing the potential of the drive signal COM from being reduced. In addition, the reduction in the potential does not occur in normal use, but if there is a possibility that the reduction occurs under the worst condition, it is preferable to use the dummy pulse in normal use.

Even in the third embodiment, among two durations EEP and NEP constituting the respective drive signal period Pcom, the ink non-ejection duration NEP (second duration) is set to be equal to or longer than the ink ejection duration EEP (first duration), it thereby prevents the head from being overheated. Further, the dummy pulse is generated in ink non-ejection duration NEP, thereby maintaining the voltage stability of the head drive section 45.

Fourth Embodiment

Example of Using Multiple Drive Signals

Figure 10:
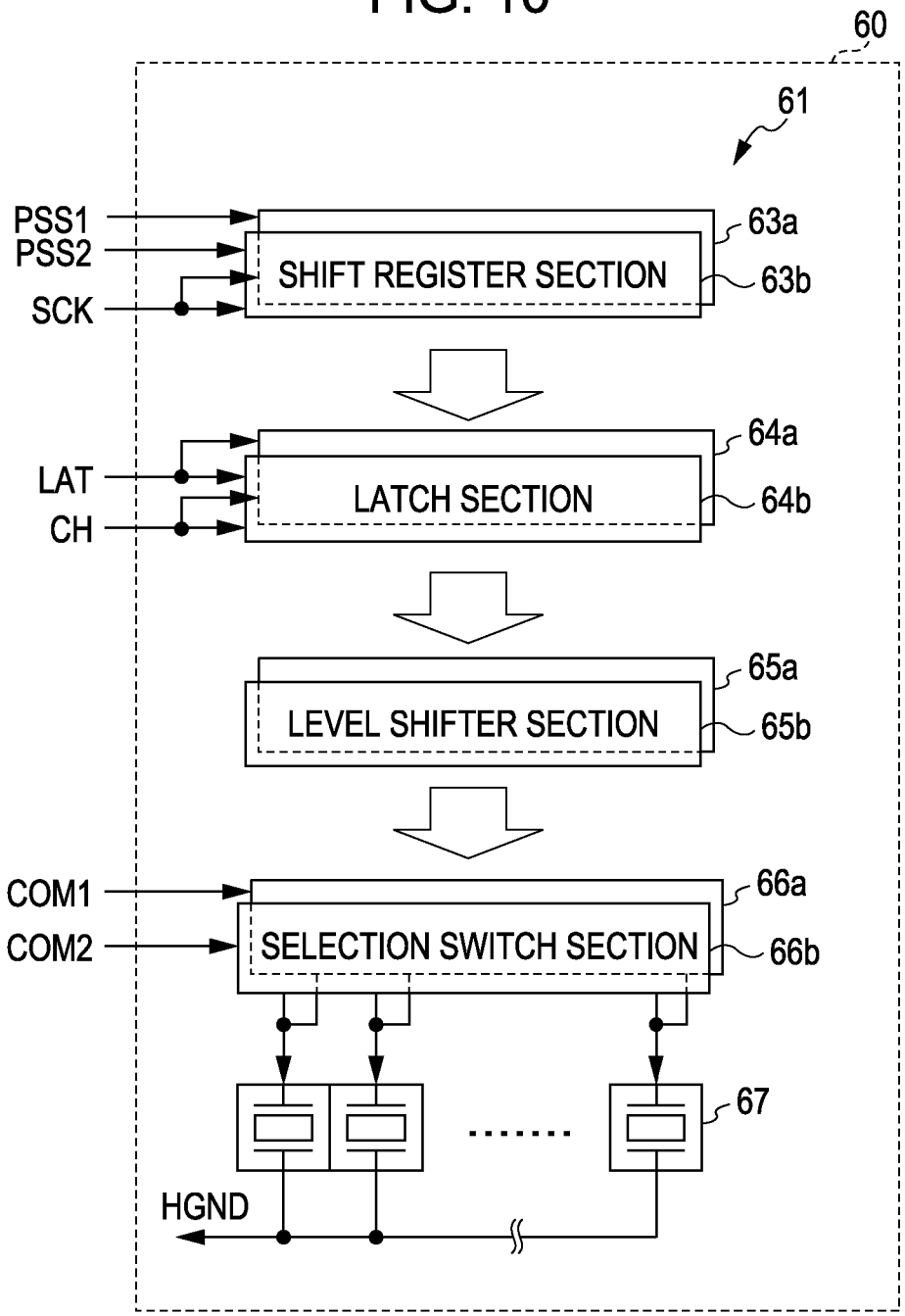
FIG. 10 is a block diagram illustrating the configuration of a switching control section in a fourth embodiment.

FIG. 10 is a block diagram illustrating the switching control section 61 in a fourth embodiment, and a view corresponding to FIG. 3 in the first embodiment. The difference between FIG. 10 and FIG. 3 is that two sets of shift register sections 63*a* and 63*b*, two sets of latch sections 64*a* and 64*b*, two sets of level shifter sections 65*a* and 65*b*, and two sets of selection switch sections 66*a* and 66*b* are provided in the switch control section 61*a* in FIG. 10. Different pulse selection signals PSS1 and PSS2 are supplied to the two sets of shift register sections 63*a* and 63*b*. However, same clock signal SCK is supplied to the two sets of shift register sections 63*a* and 63*b*. Same latch signal LAT and same channel signal CH are supplied to two sets of latch sections 64*a* and 64*b*.

However, different latch signals LAT and different channel signals CH may be supplied to two sets of latch sections 64*a* and 64*b*. Two different drive signals COM1 and COM2 are supplied to two sets of selection switch sections 66*a* and 66*b*. The circuit sections 63*a*, 64*a*, 65*a* and 66*a* that the letter "a" is added to the end of the reference numerals are used to select the pulse of the first drive signal COM1. Further, the circuit sections 63*b*, 64*b*, 65*b* and 66*b* that the letter "b" is added to the end of the reference numerals are used to select the pulse of the second drive signal COM2. The output terminals of two selection switches 66*a* and 66*b* provided with respect to each nozzle are connected in common to one piezoelectric element 67 of the nozzle. Therefore, any one of two drive signals COM1 and COM2 may be selectively supplied to the piezoelectric element 67 of the respective nozzle.

Figure 11:
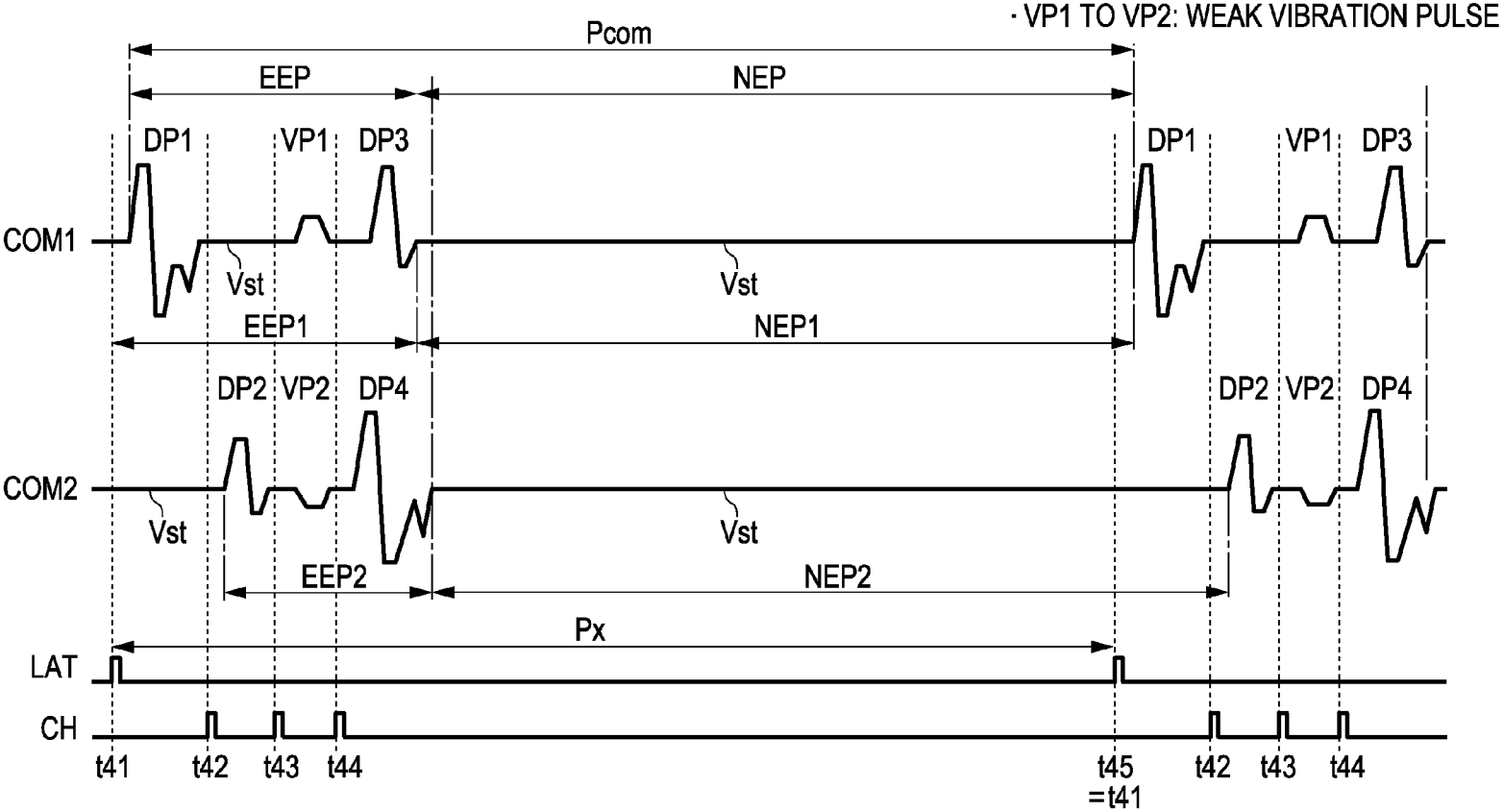
FIG. 11 is a timing chart illustrating the waveforms of the plurality of drive signals in the fourth embodiment.

FIG. 11 is a timing chart illustrating the waveforms of two drive signals used in the fourth embodiment. The first drive signal COM1 includes two ink ejecting pulses DP1 and DP3, and one weak vibration pulse VP1. The timings for the pulses DP1, VP1 and DP3 of the first drive signal COM1 are the pulse timings t41, t43 and t44 of the channel signal CH. On the other hand, the second drive signal COM2 includes two ink ejecting pulses DP2 and DP4, and one weak vibration pulse VP2. The timings for the pulses DP2, VP2 and DP4 of the second drive signal COM2 are the pulse timings t42, t43 and t44 of the channel signal CH. In this example, it is possible to form many kinds of ink dots by the combination of four ink ejecting pulses DP1 to DP4 included in two drive signals COM1 and COM2. For example, it is possible to form ink dots with different amounts of four kinds of inks by selecting only one of the four kinds of inks ejecting pulses DP1 to DP4. Further, it is allowed to select two or more ink ejecting pulses in one pixel period Px, whereby larger ink dots may be formed.

As shown at the top of FIG. 11, the drive signal period Pcom is divided into the ink ejection duration EEP (first duration) and the ink non-ejection duration NEP (second duration). However, in a case where a plurality of drive signals are simultaneously generated like the example, the division between the ink ejection duration EEP and the ink non-ejection duration NEP is determined from all of the plurality of drive signals. Specifically, in FIG. 11, in a case of considering only the first drive signal COM1, the ink ejection duration EEP1 may be determined as one continuous time duration from the start timing of the first ink ejecting pulse DP1 to the termination timing of the last ink ejecting pulse DP3. The ink non-ejection duration NEP1 of the first drive signal COM1 is a duration other than the ink ejection duration EEP1. On the other hand, in a case of considering only the second drive signal COM2, the ink ejection duration EEP2 may be determined as one continuous time duration from the start timing of the first ink ejecting pulse DP2 to the termination timing of the last ink ejecting pulse DP4. The ink non-ejection duration NEP2 of the second drive signal COM2 is a duration other than the ink ejection duration EEP2. The ink ejection duration EEP that includes the total of two drive signals COM1 and COM2 is a duration that is set by taking a logical sum (OR) of the ink ejection duration EEP1 of the first drive signal COM1 and the ink ejection duration EEP2 of the second drive signal COM2. Further, the ink non-ejection duration NEP that includes the total of two drive signals COM1 and COM2 is a duration that is set by taking a logical product (AND) of the ink non-ejection duration NEP1 of the first drive signal COM1 and the ink non-ejection duration NEP2 of the second drive signal COM2.

In addition, the ink non-ejection duration NEP is a duration except for the ink ejection duration EEP from the drive signal period Pcom.

In addition, the head drive section 45 may simultaneously generate three or more drive signals to supply to the print head 60. If using a plurality of drive signals, it is possible to increase the number of ink dots having different sizes. In addition, in general, with respect to the ink ejection duration EEP and the ink non-ejection duration NEP in a case of generating simultaneously the plurality of drive signals, it may be considered that all the drive signals are overlapped and synthesized into one virtual drive signal and then the ink ejection duration and the ink non-ejection duration in the one virtual drive signal are determined.

In the fourth embodiment, even in a case where the head drive section 45 simultaneously generates a plurality of drive signals to supply to the print head, the ink non-ejection duration NEP (second duration) has been set to be equal to or longer than the ink ejection duration EEP (first duration), it thereby prevents the head from being overheated.

Fifth Embodiment

Example of Using Drive Signal in Multi-Main Scanning Recording Method

In the fifth embodiment, the print operation referred to as a multi-main scanning recording method uses the drive signals of the aforementioned embodiment. Therefore, in the following description, first, the multi-main scanning recording method is described, and then the method of using the drive signals in the multi-main scanning recording method is described.

Figures 12A, 12B:
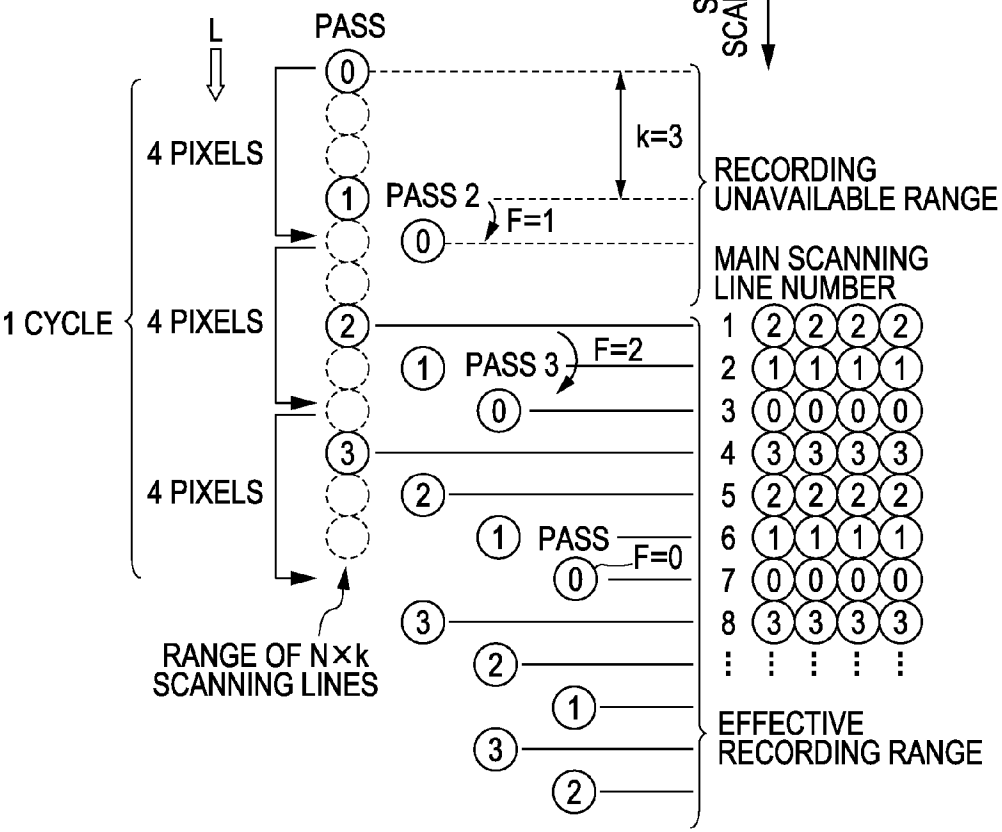
FIGS. 12A and 12B are explanatory diagrams of a non-multi main scanning recording method.

FIGS. 12A and 12B are explanatory diagrams illustrating an example of a normal dot recording method (non-multi main scanning recording method). FIG. 12A illustrates an example of the sub-scanning feed in a case of using four nozzles, and FIG. 12B illustrates parameters of the dot recording method. In FIG. 12A, circles in solid lines each containing numbers indicates the positions of four nozzles in the sub-scanning direction in each pass. Here, "pass" means one main scanning. The numbers 0 to 3 inside the circles are nozzle numbers. In the example, the position of four nozzles is sent in the sub-scanning direction every time the one main scanning is terminated. However, in practice, the feed in the sub-scanning direction is achieved by moving sheets using the sheet feed motor 22 (FIG. 2).

As shown in the left end of FIG. 12A, the sub-scanning feed amount L is a constant value of four pixels in the example. Therefore, every time the sub-scanning feed is performed, the position of the respective nozzle is shifted by four pixels in the sub-scanning direction. In each nozzle, dot recording is permitted in all pixel positions on each main scanning line during one main scanning. In the right end of FIG. 12A, the numbers of the nozzles which perform the dot recording on the respective main scanning line are shown. Further, in the main scanning lines drawn by the broken lines extending in the right direction (main scanning direction) from circles indicating the sub-scanning direction positions of the nozzles, dots cannot be recorded on the lower main scanning line adjacent thereto, and thus the recording of dots is actually prohibited. On the other hand, in the main scanning line drawn by a solid line extending in the main scanning direction, dots can be recorded on the lower main scanning line adjacent thereto. In this manner, the range of the main scanning line in which the dot recording is actually performed on adjacent main scanning lines is referred to as an effective recording range (or "effective print range"). However, the sub-scanning feed is performed with a smaller feed amount in the vicinity of the upper end and in the vicinity of the lower end of the print medium, thereby performing the dot recording even in the range (recording unavailable range) other than the effective recording range shown in FIGS. 12A and 12B.

In the upper part of FIG. 12B, various scanning parameters relating to the dot recording method are shown. The scanning parameter includes nozzle pitch k [pixel], used nozzle number N [piece], main scanning repetition number s, effective nozzle number Neff [pieces] and sub-scanning feed amount L [pixel]. In this example, the nozzle pitch k is three pixels. The value of the nozzle pitch k can be set as any integer of one or more, but from the view point of an image quality, it is preferable that the value can be set as an integer of two or more. Further, in an example of FIGS. 12A and 12B, the used nozzle number N for any one color is four. In addition, the used nozzle number N is the number of the actual used nozzle among a plurality of nozzles mounted for the ejection of ink of each color. In fact, a few tens of nozzles are usually used per one color, but for convenience of description, the used nozzle number N of is set to four. The main scanning repetition number s means the number that the main scanning is performed on each main scanning line for dot formation. For example, when the main scanning repetition number s is two, two times of main scanning is performed on each main scanning line for dot formation, and at this time, the dot recording is permitted intermittently at pixel positions of every other pixel in one main scanning. In cases of FIGS. 12A and 12B, the main scanning repetition number s is one, and the dot recording is permitted in all pixel positions on the respective main scanning lines in one main scanning. The effective nozzle number Neff is a value obtained by dividing the used nozzle number N by the main scanning repetition number s. It can be considered that the effective nozzle number Neff indicates the net number of the main scanning lines that the dot recording is completed with one time of main scanning.

The sub-scanning feed amount L, the cumulative total value ΣL thereof and the offset F of the nozzle in each pass are shown in the table of FIG. 12B. Here, when it is assumed that the periodic positions (the positions of every four pixels in FIGS. 12A and 12B) of the nozzle in the first pass 1 is the reference position (zero offset), the offset F (position shift amount) is a value indicating how many pixels the position of the nozzle in each subsequent pass is away from the reference position in the sub-scanning direction. For example, as shown in FIG. 12A, after one pass, the position of the nozzle is moved by the sub-scanning feed amount L (=four pixels) in the sub-scanning direction.

On the other hand, the nozzle pitch k is three pixels. Therefore, the offset F of the nozzle in pass 2 is one (refer to FIG. 12A). Similarly, the position of the nozzle in pass 3 is moved by ΣL=8 pixels from the initial position and the offset F is two. The position of the nozzle in pass 4 is moved by ΣL=12 pixels from the initial position and the offset F is zero. In pass 4 after three sub-scanning feeds, the offset F of the nozzle returns to zero, by repeating the cycle by taking three sub-scannings as one cycle, it is possible to record dots in all pixel positions on the main scanning line of the effective recording range. As can be seen from the example in FIGS. 12A and 12B, when the position of the nozzle is apart from the initial position by the integer multiple of the nozzle pitch k, the offset F is zero. In general, the offset F is given by the remainder (ΣL) % k obtained by dividing the cumulative total value ΣL of the sub-scanning feed amount L by the nozzle pitch k. Here, "%" is an operator which indicates that the remainder of the division is taken.

When the main scanning repetition number s is 1, the scanning parameter is set to satisfy following conditions such that there is no omission or duplication in the main scanning line to be recorded in the effective recording range.

Condition c1: the number of the sub-scanning feed of 1 cycle is equal to the nozzle pitch k.

Condition c2: the offsets F of the nozzles after each sub-scanning feed during 1 cycle have different values from each other in the range of 0 to (k−1).

Condition c3: the average feed amount (ΣL/k) of the sub-scanning is equal to the number of the used nozzle N.

With respect to each of the above conditions is described in detail, for example, in JP-A-2002-11859 along with FIG. 6, the description thereof is omitted here.

FIGS. 13A and 13B are explanatory diagrams illustrating an example of the dot recording method in a case where main scanning repetition number s is 2. In a case where the main scanning repetition number s exceeds 1, s times of the main scanning is performed on the same main scanning line. The dot recording method of the case where the main scanning repetition number s exceeds 1 is referred to as "multi-main scanning recording method." Further, the dot recording method of the case where the main scanning repetition number s is equal to 1 is referred to as "non multi-main scanning recording method."

The scanning parameters of the dot recording method shown in FIGS. 13A and 13B are obtained by changing the main scanning repetition number s and the sub-scanning feed amount L from the scanning parameters shown in FIG. 12B. As can be seen from FIG. 13A, the sub-scanning feed amount L in the dot recording method is a constant value of two pixels. In FIG. 13A, the positions of the nozzles in even numbers of passes are denoted by a diamond. In general, as shown in the right end of FIG. 13A, the positions of the pixels to be recorded in even numbers of passes are shifted by one pixel in the main scanning direction from the positions of the pixels to be recorded in odd numbers of passes. Therefore, a plurality of pixel positions on the main scanning line are intermittently recorded by two different nozzles each. For example, in the uppermost main scanning line within the effective recording range, after dots are recorded intermittently in the pixel positions of every other one pixel by number 2 nozzle in pass 2, dots are recorded intermittently in the pixel positions of every other one pixel by number 0 nozzle in pass 5. In the multi-main scanning recording method, each nozzle is driven at intermittent timings such that after the dot recording is allowed in one pixel position during one main scanning, the dot recording is prohibited in subsequent (s−1) pixel positions.

The value of the offset F in each pass during one cycle is shown in the lowermost of the table of FIG. 13B. One cycle includes six passes and the offset F in each of passes from pass 2 to pass 7 includes the value in the range of 0 to 2 two times. Further, the change in the offset F in three passes from pass 2 to pass 4 is equal to the change in the offset F in three passes from pass 5 to pass 7. As shown in the left end of FIG. 13A, six passes of one cycle can be divided into two sets of small cycles of three for each. In this case, one cycle is completed by repeating the small cycle s times.

In general, in a case where the main scanning repetition number s exceeds 1, the above first to third conditions c1 to c3 are rewritten as the following conditions c1' to c3'.

Condition c1': the number of the sub-scanning feed of 1 cycle is equal to the value (k×s) obtained by multiplying the nozzle pitch k by the main scanning repetition number s.

Condition c2': the offsets F of the nozzles after each sub-scanning feed during 1 cycle are values in the range of 0 to (k−1), and each value appears s times for each.

Condition c3': the average feed amount $\{\Sigma L/(k\times s)\}$ of the sub-scanning is equal to the effective nozzle number Neff (=N/s).

The conditions c1' to c3' are established when the main scanning repetition number s is 1. Therefore, the conditions c1' to c3' are considered as a condition that is generally established irrespective of the value of the main scanning repetition number s. That is, if the three conditions c1' to c3' are satisfied, it is possible to perform the dot recording such that there is no omission or unnecessary duplication in the pixel positions used for recording in the effective recording range. However, in a case of performing the dot recording in the multi-main scanning recording method, in s times of main scanning, a condition is established where the pixel positions in which the dot recording is allowed are shifted with each other in the main scanning direction. In addition, in FIGS. 12A, 12B, 13A and 13B, the case where the sub-scanning feed amount L is a constant value is described, but the conditions c1' to c3' are not limited to the case where the sub-scanning feed amount L is a constant value, but can be applied to the case of using a combination of a plurality of different values as the sub-scanning feed amount.

The operation of the above multi-main scanning recording method can be considered as the recording operation in which on each main scanning line along the main scanning direction, entire ink ejections demanded on each main scanning line is not completed by one time of main scanning, but is completed by two times or more of main scanning. In addition, in the print operation of FIGS. 13A and 13B, the main scanning operation and the sub-scanning operation are alternately and repeatedly performed, but it is not necessary to alternately perform the main scanning operation and the sub-scanning operation. For example, the print operation can be employed in which after the main scanning operation is performed two times, the sub-scanning operation is performed one time.

Figure 14:
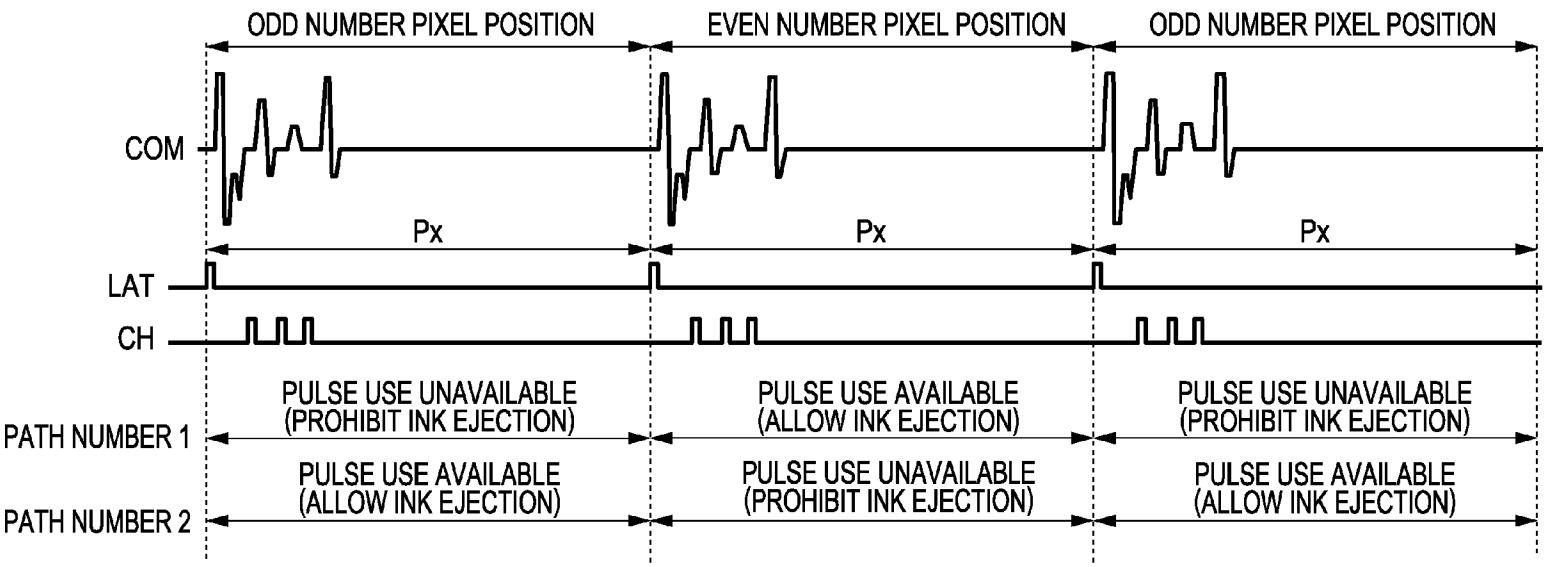
FIG. 14 is an explanatory diagram for explaining the state of use of drive signal pulses in a case of printing in a multi-main scanning recording method in a fifth embodiment.

FIG. 14 is an explanatory diagram for explaining the state of use of drive signal pulses COM in a case of printing in a multi-main scanning recording method using the pulses in a fifth embodiment. The drive signal COM is the same as drive signal COM in the first embodiment shown in FIG. 6. Instead of this, the drive signals of other embodiments may be used.

In the lower part of FIG. 14, whether the use of the ink ejecting pulses of the drive signal COM in two passes to scan the same main scanning line are allowed, is illustrated. That is, in the first pass (pass of pass number 1), the ink ejecting pulses are available in even number pixel positions, but the ink ejecting pulses of the drive signal COM are unavailable in odd number pixel positions. In other words, in the first pass, the ink ejections are available in even number pixel positions, but the ink ejections are unavailable in odd number pixel positions. On the other hand, in the second pass, contrary to the first pass, the ink ejecting pulses are available in odd number pixel positions, but the ink ejecting pulses of the drive signal COM are unavailable in even number pixel positions. In the pixel positions where the use of the ink ejecting pulses are allowed, any one of pulse selection signals PSS in FIG. 5 is used. On the other hand, in the pixel positions where the use of the ink ejecting pulses are prohibited, the value "0010" (or "0000") indicating non-dot is used as pulse selection signals PSS.

As shown in FIG. 14, in a case where the ink ejection on the same main scanning line is completed by a plurality of passes in the print operation of the multi-main scanning recording method, at most the drive signal COM of every other one pixel position (that is, at a ratio of one pixel to two pixels) is only applied to the piezoelectric element 67 in respective passes. Therefore, if using the drive signal COM described in the aforementioned other embodiment in the multi-main scanning method, there is an advantage that it is possible to further suppress the temperature rise in the head.

FIG. 15 is a view illustrating print modes that can be set by various print setting parameters in the fifth embodiment. In this example, as the print setting parameter, five parameters including a print resolution, a main scanning repetition number s, a maximum ink amount, reciprocating movement and a carriage velocity are used. Then, eight print modes M1 to M8 that are different from each other are set according to the combination of these parameters. The column "print resolution" shows [main scanning direction resolution]×[sub-scanning direction resolution]. Further, the column "maximum ink amount" shows the largest amount of ink droplets that can be ejected per one pixel in respective print modes. Further, in the column "reciprocating movement", "Bi-d" shows bidirectional print and "Uni-d" shows unidirectional print. In addition, the bidirectional print means a print which performs an ink ejection in both main scanning of the forward movement and the rearward movement and the unidirectional print means a print which performs an ink ejection only in either main scanning that is selected in advance among the forward movement and the rearward movement.

The first print mode M1 is a mode in which the print resolution is 360×360 dpi, the main scanning repetition number s is one, the maximum ink amount is 24 picoliter, the reciprocating movement is bi-direction, and the carriage velocity is high. On the other hand, the eighth print mode M8 is a mode in which the print resolution is 1440×720 dpi, the main scanning repetition number s is two, the maximum ink amount is 8 picoliter, the reciprocating movement is uni-direction and the carriage velocity is low. In addition, it is possible to store in advance the relationship between this parameter and the print mode, for example, within the printer driver of the computer 90 or the ROM 53 in FIG. 2 of the main control section 42.

In addition, it is not necessary to determine the print modes in response to all parameters shown in FIG. 15, but the print modes may be determined in response to a part among all parameters. For example, the print modes may be determined in response to three parameters of the print resolution, the main scanning repetition number and the reciprocating movement.

Among the print modes shown in FIG. 15, the maximum ink amount is largest in the first four print modes M1 to M4, thus from this point, it is considered that the head temperature is likely to rise equal to or higher than the other four print modes M5 to M8. Further, as described in FIG. 7 of the first embodiment, as the carriage velocity is higher, there is a tendency that the head temperature is likely to rise. Therefore, in the print modes M1 to M4, it is preferable to set the carriage velocity not excessively high in order for the head not to be overheated. Further, as described in FIG. 6, it is preferable to set these durations NEP and EEP such that the ink non-ejection duration NEP of the drive signal COM becomes equal to or longer than the ink ejection duration EEP.

In four print modes M5 to M8 in lower part of FIG. 15, the rise in the head temperature is expected to be relatively slow. Therefore, in these print modes M5 to M8, compared to the print mode (for example, mode M1) which is most strict in terms of the rise in the head temperature, the ratio of the ink non-ejection duration NEP in the drive signal period Pcom may be set small. However, even in this case, it is preferable to set the ink non-ejection duration NEP equal to or longer than the ink ejection duration EEP.

Even in the aforementioned fifth embodiment, since the print is performed using the drive signal COM in which the ink non-ejection duration NEP is set to be equal to or longer than the ink ejection duration EEP, it is possible to mitigate the rise in head temperature. Especially, in the multi-main scanning recording method, during one main scanning operation, the ink ejection is allowed in a part of the pixel positions on respective scanning lines but the ink ejection is prohibited in the other pixel positions, thereby further mitigating the rise in the head temperature.

MODIFICATION EXAMPLES

In addition, the invention is not limited to the aforementioned embodiment and the embodiment, but may be realized in various aspects within the range without departing from the spirit, for example, the following modifications are possible.

Modification Example 1

The aforementioned various embodiments adopts an aspect in which only a part of the drive signal is selected and applied to the piezoelectric element. Instead of this, the invention can be applied to an aspect in which all of the drive signals are applied to the piezoelectric element. Even in this case, if the drive signal period is divided into two durations of the ink ejection duration EEP (the first duration) and the ink non-ejection duration NEP (the second duration), and the ink non-ejection duration NEP is set to be equal to or longer than the ink ejection duration EEP, it is possible to prevent the head from being overheated.

Modification Example 2

The invention is not limited to the ink jet printer, but can be applied to any other liquid ejecting apparatus (referred to as "a liquid ejecting apparatus") which ejects other liquids other than ink. For example, the invention can be applied to various liquid ejecting apparatuses as follows:

(1) An image recording apparatus such as a facsimile apparatus. (2) A color material ejecting apparatus to be used in manufacturing of a color filter for an image display apparatus such as a liquid crystal display. (3) An electrode material ejecting apparatus to be used in formation of an electrode of an organic EL (Electro Luminescence) display or a surface emitting display (Field Emission Display, FED). (4) A liquid ejecting apparatus which ejects a liquid including a bio-organic material to be used in manufacturing of a biochip. (5) A specimen ejecting apparatus as a precision pipette. (6) An apparatus of ejecting a lubricant. (7) An apparatus of ejecting a resin solution. (8) A liquid ejecting apparatus which ejects a lubricant to a precision machinery such as a watch or a camera by a pinpoint. (9) A liquid ejecting apparatus which ejects a transparent resin solution such as an ultraviolet curing resin solution onto a substrate in order to form a micro hemispherical lens (an optical lens) and the like to be used in an optical communication element and the like. (10) A liquid ejecting apparatus which ejects an acidic or an alkaline etchant in order to etch a substrate. (11) A liquid ejecting apparatus having a liquid ejecting head to cause any other small amount of droplets to be ejected.

In addition, "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic agents, organic agents, liquid solutions, liquid resins, and fluid states such as liquid metals (metallic melts). Furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, ink generally includes water-based and oil-based inks, as well as various types of liquid compositions, including gel inks, hot-melt inks, and so on.

Modification Example 3

In the above embodiments, a part of the configuration realized by hardware may be replaced by software, or conversely, a part of the configuration realized by software may be replaced by hardware.

The invention is not limited to the aforementioned embodiment, embodiment and modification example, but may be realized by various configurations within the range without departing from the spirit. For example, an embodiment, an embodiment and modification example corresponding to the technical characteristics among each aspect described in the column of summary of the invention may be appropriately replaced or combined so as to solve a part or all of the aforementioned problems, alternatively, so as to achieve a part or all of the aforementioned effects. Further, if the technical characteristics are not described as essential in the specification, it can be appropriately removed.

The entire disclosure of Japanese Patent Application No. 2012-169311, filed Jul. 31, 2012 is expressly incorporated by reference herein.

What is claimed is:

1. A liquid ejecting apparatus comprising:

a drive signal generation section which generates a drive signal having at least one or more waveform parts; and a liquid ejecting head which applies at least a part of the drive signal to a piezoelectric element and causes a nozzle to eject droplets, wherein the drive signal is a periodic signal, one period of the drive signal has two durations of (i) a droplet ejection duration with a waveform part used to eject the droplet from the nozzle and (ii) a droplet non-ejection duration without the waveform part used to eject the droplet from the nozzle, and the droplet non-ejection duration is equal to or longer than the droplet ejection duration.

2. The liquid ejecting apparatus according to claim 1, wherein the droplet non-ejection duration has a length of 1.5 times or more the droplet ejection duration.

3. The liquid ejecting apparatus according to claim 1, wherein the droplet ejection duration is one continuous time duration with the waveform part used to eject the droplet from the nozzle, and the droplet non-ejection duration is a time duration without the waveform part used to eject the droplet from the nozzle.

4. The liquid ejecting apparatus according to claim 1, wherein the droplet ejection duration is a time duration with the waveform part used to eject the droplet from the nozzle, and the droplet non-ejection duration is one continuous time duration without the waveform part used to eject the droplet from the nozzle.

5. The liquid ejecting apparatus according to claim 1, wherein the droplet ejection duration is one continuous time duration with the waveform part used to eject the droplet from the nozzle, and the droplet non-ejection duration is one continuous time duration without the waveform part used to eject the droplet from the nozzle.

6. The liquid ejecting apparatus according to claim 1, wherein the droplet ejection duration includes a plurality of the waveform parts used to eject the droplet from the nozzle.

7. The liquid ejecting apparatus according to claim 1, wherein the droplet non-ejection duration includes a dummy waveform part in which if the dummy waveform part is applied to the piezoelectric element, the droplet is ejected from the nozzle, but the dummy waveform part is not actually applied to the piezoelectric element.

8. The liquid ejecting apparatus according to claim 1, wherein the droplet non-ejection duration includes a waveform part in which even if the waveform part is applied to the piezoelectric element, the droplet is not ejected from the nozzle.

9. The liquid ejecting apparatus according to claim 1, wherein the lengths of the droplet ejection duration and the droplet non-ejection duration are set such that the maximum ejection amount of the droplet per unit time from the nozzle is less than 6000 picoliter/second.

10. The liquid ejecting apparatus according to claim 1, wherein the drive signal generation section (a) generates only one drive signal and supplies the drive signal to the liquid ejecting head, or (b) simultaneously generates a plurality of drive signals and supplies the drive signals to the liquid ejecting head, and wherein the droplet ejection duration and the droplet non-ejection duration are determined from all the plurality of drive signals.

11. A method of controlling ejection of droplets from a liquid ejecting head by supplying a drive signal having at least one or more waveform parts to the liquid ejecting head which causes a nozzle to eject the droplets using a piezoelectric element, wherein the drive signal is a periodic signal, one period of the drive signal has two durations of (i) a droplet ejection duration with a waveform part used to eject the droplets from the nozzle and (ii) a droplet non-ejection duration without the waveform part used to eject the droplets from the nozzle, and the droplet non-ejection duration is equal to or longer than the droplet ejection duration.

12. The method according to claim 11, wherein the droplet non-ejection duration has a length of 1.5 times or more the droplet ejection duration.

13. The method according to claim 11, wherein the droplet ejection duration is one continuous time duration with the waveform part used to eject the droplets from the nozzle, and the droplet non-ejection duration is a time duration without the waveform part used to eject the droplets from the nozzle.

14. The method according to claim 11, wherein the droplet ejection duration is a time duration with the waveform part used to eject the droplets from the nozzle, and the droplet non-ejection duration is one continuous time duration without the waveform part used to eject the droplets from the nozzle.

15. The method according to claim 11, wherein the droplet ejection duration is one continuous time duration with the waveform part used to eject the droplets from the nozzle, and the droplet non-ejection duration is one continuous time duration without the waveform part used to eject the droplets from the nozzle.

16. The method according to claim 11, wherein the droplet ejection duration includes a plurality of the waveform parts used to eject the droplets from the nozzle.

17. The method according to claim 11, wherein the droplet non-ejection duration includes a dummy waveform part in which if the dummy waveform part is applied to the piezoelectric element, the droplets are ejected from the nozzle, but the dummy waveform part is not actually applied to the piezoelectric element.

18. The method according to claim 11, wherein the droplet non-ejection duration includes a waveform part in which even if the waveform part is applied to the piezoelectric element, the droplet is not ejected from the nozzle.

19. The method according to claim 11, wherein the lengths of the droplet ejection duration and the droplet non-ejection duration are set such that the maximum ejection amount of the droplets per unit time from the nozzle is less than 6000 picoliter/second.

20. The method according to claim 11, wherein (a) only one drive signal is supplied to the liquid ejecting head, or (b) a plurality of drive signals are simultaneously supplied to the liquid ejecting head, and wherein the droplet ejection duration and the droplet non-ejection duration are determined from all the plurality of drive signals.

* * * * *